US007338375B1

(12) United States Patent
Small

(10) Patent No.: US 7,338,375 B1
(45) **Date of Patent: *Mar. 4, 2008**

(54) INTEGRATED VOICE AND DATA COMMUNICATION FOR LASER TAG SYSTEMS

(75) Inventor: David Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 459 days.

This patent is subject to a terminal disclaimer.

(21) Appl. No.: 10/177,652

(22) Filed: Jun. 20, 2002

Related U.S. Application Data

(60) Provisional application No. 60/358,984, filed on Feb. 21, 2002.

(51) Int. Cl.
*A63F 13/00* (2006.01)

(52) U.S. Cl. ..... 463/39

(58) Field of Classification Search ..... 463/39, 463/40, 49, 51, 57; 446/405, 406
See application file for complete search history.

(56) References Cited

U.S. PATENT DOCUMENTS

| | | | | |
|---|---|---|---|---|
| 2,100,348 | A | 11/1937 | Nicolson | |
| 2,494,645 | A | 1/1950 | Collins | |
| 2,990,471 | A | 6/1961 | Tiffany | |
| 3,277,303 | A | 10/1966 | Jensen et al. | |
| 3,705,986 | A | 12/1972 | Sanders et al. | |
| 3,927,316 | A | 12/1975 | Citta | |
| 4,008,478 | A | 2/1977 | Ikrath et al. | |
| 4,056,719 | A | 11/1977 | Waaben | |
| 4,151,407 | A | 4/1979 | McBride et al. | |
| 4,249,265 | A | 2/1981 | Coester | |
| 4,352,665 | A | 10/1982 | Kimble et al. | |
| 4,456,793 | A | 6/1984 | Baker et al. | |
| 4,603,975 | A | 8/1986 | Cinzori | |
| 4,648,131 | A | 3/1987 | Kawaguchi et al. | |
| 4,689,827 | A | 8/1987 | Gurney, Jr. | |
| 4,709,411 | A | 11/1987 | Mori | |
| 4,717,913 | A | 1/1988 | Elger | |
| 4,823,401 | A | 4/1989 | Gammarino et al. | |
| 4,936,037 | A | 6/1990 | Holcomb et al. | |
| 4,959,827 | A | 9/1990 | Grotzinger et al. | |
| 4,996,787 | A | 3/1991 | Holcomb et al. | |
| 5,044,107 | A | 9/1991 | Holford | |
| 5,319,190 | A | 6/1994 | Allen et al. | |
| 5,359,446 | A | 10/1994 | Johnson et al. | |
| 5,455,702 | A | 10/1995 | Reed et al. | |
| 5,495,357 | A * | 2/1996 | Osterhout | 398/107 |
| 5,648,862 | A | 7/1997 | Owen | |
| 5,721,783 | A | 2/1998 | Anderson | |
| 5,763,900 | A | 6/1998 | Wang | |

(Continued)

*Primary Examiner*—Kim Nguyen
(74) *Attorney, Agent, or Firm*—Blakely Sokoloff Taylor & Zafman LLP

(57) ABSTRACT

An electronic toy gun for data and audible sound/voice communication. Audible sound/voice may be communicated over an infrared beam or a radio frequency signal while data is communication over an infrared beam. The toy laser tag gun includes an IR receiver, an IR transmitter, a speaker, and a microphone 210. The IR receiver receives an incoming IR beam. The IR transmitter 206 generates an IR output beam. A pair of toy laser tag guns form an IR communication system with one or more RF and/or IR communication channels. Simplex and full duplex IR communication may be provided over one or more IR communication channels.

67 Claims, 14 Drawing Sheets

U.S. PATENT DOCUMENTS 5,802,467 A 9/1998 Salazar et al.
5,835,862 A 11/1998 Nykanen et al.
5,904,621 A * 5/1999 Small et al. ..... 463/52
5,995,592 A 11/1999 Shirai et al.
6,154,663 A 11/2000 Itamochi
6,278,378 B1 8/2001 Feiner et al.
6,281,811 B1 8/2001 Ranzino
6,285,476 B1 9/2001 Carlson et al.
6,302,796 B1 10/2001 Lebensfeld et al.
6,314,401 B1 11/2001 Abbe et al.
6,893,346 B2 5/2005 Small et al.

* cited by examiner

INTEGRATED VOICE AND DATA COMMUNICATION FOR LASER TAG SYSTEMS

CROSS-REFERENCE TO RELATED APPLICATIONS

This United States (US) non-provisional patent application filed by David Small claims the benefit of U.S. provisional patent application Ser. No. 60/358,984, filed by David Small on Feb. 21, 2002, entitled "INTEGRATED VOICE AND DATA COMMUNICATION FOR LASER TAG SYSTEMS".

FIELD OF THE INVENTION

The present invention relates generally to the field of toys. Particularly, the present invention relates to interactive shooting toy games and electronic toy guns.

BACKGROUND OF THE INVENTION

The electromagnetic spectrum has frequencies associated with it in which electromagnetic radiation may be radiated. The electromagnetic spectrum can be divided into frequency regions that exhibit common properties useful in science and technology. For example, the audible range of frequencies is approximately between 20 Hertz (Hz) to 20,000 Hz which humans can here. There is a radio frequency band of the electromagnetic spectrum which is allocated for radio, including cellular phones, and television communication systems. Electromagnetic radiation in the radio frequency bands tends to bend around, reflect off of and pass through objects, and thus, is favorable to communication systems. There is a narrow band referred to as the visible spectrum between $3.95\times10^{14}$ Hz to $7.90\times10^{14}$ Hz over which the radiant energy is visible to a human eye. The visible spectrum may divided into frequencies of color. Just below the visible spectrum is the infrared (IR) frequency spectrum which is in the range between $3\times10^{11}$ Hz to $4\times10^{14}$ Hz which is not visible to the human eye. More typically, the frequency of electromagnetic radiation in the IR frequency spectrum is expressed in wavelengths because of its light properties. In this case, the wavelength of light ($\lambda$) is proportional to the inverse of the frequency (f) and can be expressed in equation form as $\lambda=C/f$ where C is the speed of light.

Infrared (IR) radiation having properties of light travels in a straight, or line-of-sight, path. IR radiation is blocked by opaque objects and typically reflects well off of only hard, mirror-like surfaces. Thus, electromagnetic radiation in the IR frequency spectrum, referred to as IR radiation, is not typically used in audible communication systems such as cellular telephones and voice radios.

One system that uses infrared radiation for data communication is an electronic game for children which is more commonly referred to as a laser tag or LAZER TAG® game. One embodiment of a laser tag game is disclosed in U.S. Pat. No. 5,904,621 titled "ELECTRONIC GAME WITH INFRARED EMITTER AND SENSOR" by David Bernard Small et al. In the embodiment of the laser tag game described in U.S. Pat. No. 5,904,621, only data is communicated via the infrared emitter and sensor between each of the hand-held electronic toy guns. The data typically communicated is a tag that is fired between the hand-held electronic toy guns. In order for data to be communicated, the data is modulated or encoded onto a carrier frequency.

The carrier waveform modulated by the data is then transmitted using an infrared beam. There is no voice communication capability provided by the hand-held electronic toy guns in U.S. Pat. No. 5,904,621.

BRIEF DESCRIPTION OF THE DRAWINGS

The features of the invention will become apparent from the following detailed description of the invention in which.

Like reference numbers and designations in the drawings indicate like elements providing similar functionality.

DETAILED DESCRIPTION OF THE INVENTION

In the following detailed description of the invention, numerous specific details are set forth in order to provide a thorough understanding of the present invention. However, the invention may be practiced without these specific details. In other instances well known methods, procedures, components, and circuits have not been described in detail so as not to unnecessarily obscure aspects of the present invention.

Figure 1A:
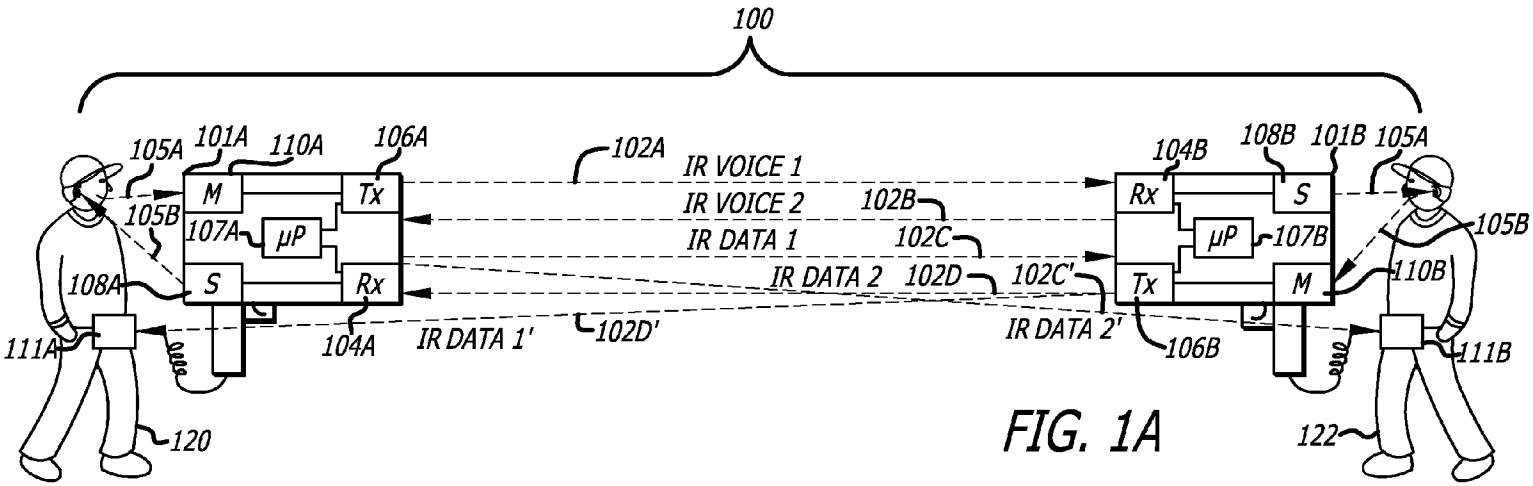
FIG. 1A is a block diagram of a laser tag gaming system with an integrated data and voice infrared (IR) communication system.

Referring to FIG. 1A, an electronic toy shooting game system or laser tag game system 100 is illustrated. The electronic toy shooting game system or laser tag game system 100 includes voice and data communication over IR communication channels between end users. The laser tag game system 100 facilitates a game of tag and voice communication using infrared light communication between a plurality of players. Each player is provided with a hand held electronic toy gun (i.e., a toy laser tag gun) which includes an IR transmitter to fire or transmit data and voice signals and an IR receiver to receive data and voice signals. The IR receiver may also be referred to as a target.

The laser tag game system 100 includes a first hand held electronic toy gun (i.e., toy laser tag gun) 101A and a second hand held electronic toy gun (i.e., toy laser tag gun) 101B. More than two laser tag guns may be utilized in the laser tag game system 100. Between the first and second hand held electronic toy guns (i.e., toy laser tag guns) 101A-101B, one or more infrared communication channels may be established within the line-of-sight of each. In an alternate embodiment, the laser tag game system 100 may further include body tags 111A and 111B to receive IR data and/or voice. The body tags may provide a greater reception area to receive an IR signal. Body tags 111A and 111B are typically worn by players or users 120 and 122 respectively on their bodies (e.g., torso, arms, or head) to receive an IR data and/or voice signal.

The information that may be transferred over the one or more infrared communication channels includes an IR voice signal 102A, an IR voice signal 102B, an IR data signal 102C and an IR data signal 102D. The IR voice signal 102A and the IR data signal 102C are transmitted from the first hand held electronic toy gun (i.e., toy laser tag gun) 101A to the second hand held electronic toy gun (i.e., toy laser tag gun) 101B. The IR voice signal 102B and the IR data signal 102D are transmitted from the second hand held electronic toy gun (i.e., toy laser tag gun) 101B to the first hand held electronic toy gun (i.e., toy laser tag gun) 101A.

Alternatively if body tags 111A and 111B are included as part of the laser tag game system 100, the data signals 102C and 102D may alternately be data signals 102C' and 102D', respectively. Data signal 102C' is transmitted from the first hand held electronic toy gun (i.e., toy laser tag gun) 101A to the second body tag 111B. Data signal 102D' is transmitted from the second hand held electronic toy gun (i.e., toy laser tag gun) 101B to the first body tag 111A.

Using one IR communication channel, all the voice and data signals are multiplexed and demultiplexed over the same center wavelength or frequency. Because the IR radiation is light, there is no interference for signals that cross between the toy laser tag guns. Alternatively, two IR communication channels may be provided. In this case, voice signal 102A and data signal 102C would be multiplexed or muxed onto the one IR communication channel and the voice signal 102B and the data signal 102D would be multiplexed or muxed onto the other one of the two IR communication channels. In another embodiment, four IR channels may be provided. One of the four channels may be for the IR voice signal 102A. A second of the four channels may be for the IR data signal 102C. A third of the four channels may be for the IR voice signal 102B. A fourth of the four channels may be for the IR data signal 102D. In any case, both data and voice signals may be communicated between the electronic toy guns of the laser tag game system 100.

The term voice signal is used herein-to refer to both audible voice sounds such as from a user and other audible sounds communicated by a signal. That is, audible sounds and audible voice sounds may be coupled into each of the toy laser tag guns for communication over the one or more IR communication channels between the toy laser tag guns.

In FIG. 1A, the toy laser tag gun 101A includes an IR receiver 104A, an IR transmitter 106A, a speaker 108A, and a microphone 110A. The toy laser tag gun 101B includes an IR receiver 104B, an IR transmitter 106B, a speaker 108B, and a microphone 110B. A user 120 may provide an audible sound or audible voice sound 103A to the microphone 110A. The user 120 may listen for sounds 105B from the speaker 108A. The speaker 108A of the toy laser tag gun 101A provides an audible sound or audible voice sound 105B to the user 120.

The audible sound or audible voice sound 103A provided by the user 120 may be communicated from the microphone 110A to the IR transmitter 106A and transferred over one of the IR communication channels, such as IR communication channel 102A, to the toy laser tag gun 101B. The microphone 110A converts the audible sound or voice sound into an electrical voice signal. The electrical voice signal is coupled to the IR transmitter 106A. The IR transmitter 106A transmits an IR voice signal over the IR communication channel 102A to the toy laser tag gun 101B. The IR receiver 104B of the toy laser tag gun 101B receives the IR voice signal from the IR communication channel 102A. The toy laser tag gun 101B converts the IR voice signal into an electrical voice signal and couples it to the speaker 108B. The speaker 108B generates an audible sound or audible voice sound 105A for the end user 122 to hear in response to the electrical voice signal.

The end user 122 may talk and provide an audible sound or audible voice sound 103B to the microphone 110B of the toy laser tag gun 101B. The microphone 110B converts the audible sound or voice sound into an electrical voice signal. The electrical voice signal is coupled to the IR transmitter 106B. The IR transmitter 106B transmits an IR voice signal over one of the IR communication channels, such as IR communication channel 102B, to the toy laser tag gun 101A. The IR voice signal is received by the IR receiver 104A from the IR communication channel 102B and converted into an electrical voice signal which is supplied to the speaker 108A. The speaker 108A converts the electrical voice signal into an audible sound or audible voice sound 105B. The end user 128 may listen to the audible sound or audible voice sound 105B using his/her hearing.

Figure 1B:
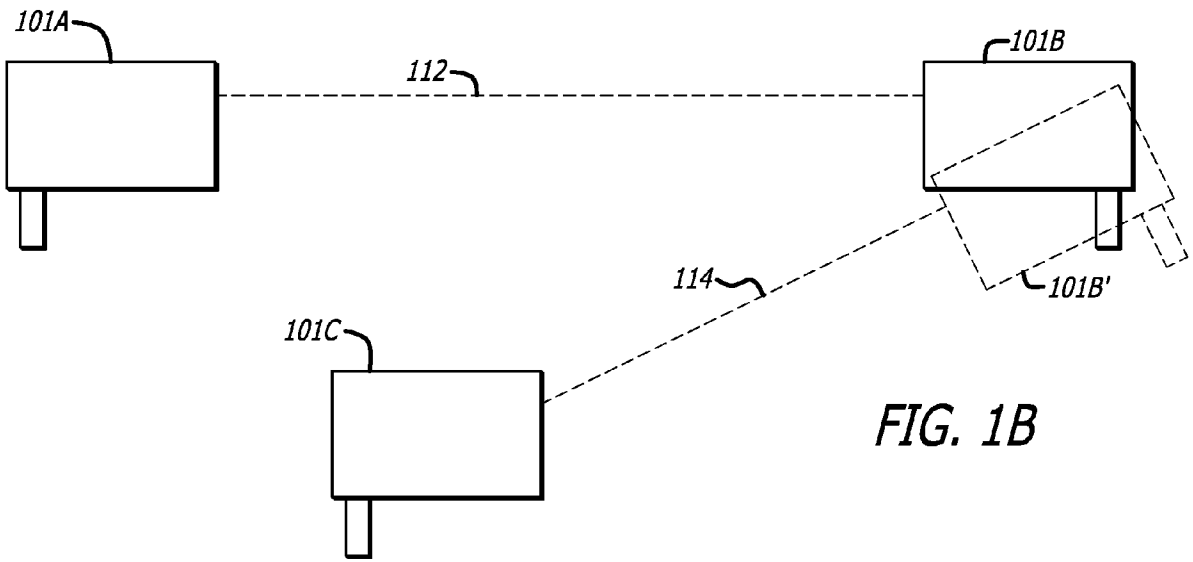
FIG. 1B is a block diagram illustrating the line-of-sight of the IR communication between multiple laser tag devices.

Referring now to FIG. 1B, toy laser tag guns 101A, 101B, and 101C are illustrated. The toy laser tag guns 101A, 101B and 101C are line of sight communication devices restricted to the spread of a transmitted IR signal and the angle of reception of the IR receiver. In FIG. 1B, toy laser tag gun 101A and 101B can communicate with each other over a line of sight 112. The toy laser tag gun 101B' is a shifted or turned version of the toy laser tag gun 101B. In FIG. 1B, the toy laser tag gun 101C can communicate with the shifted position toy laser tag gun 101B' to communicate over a line of sight 114. Each of the toy laser tag guns 101C and 101B' may be moved or turned somewhat off of the line of sight 114 and still maintain the IR communication channels between them.

Figure 2A:
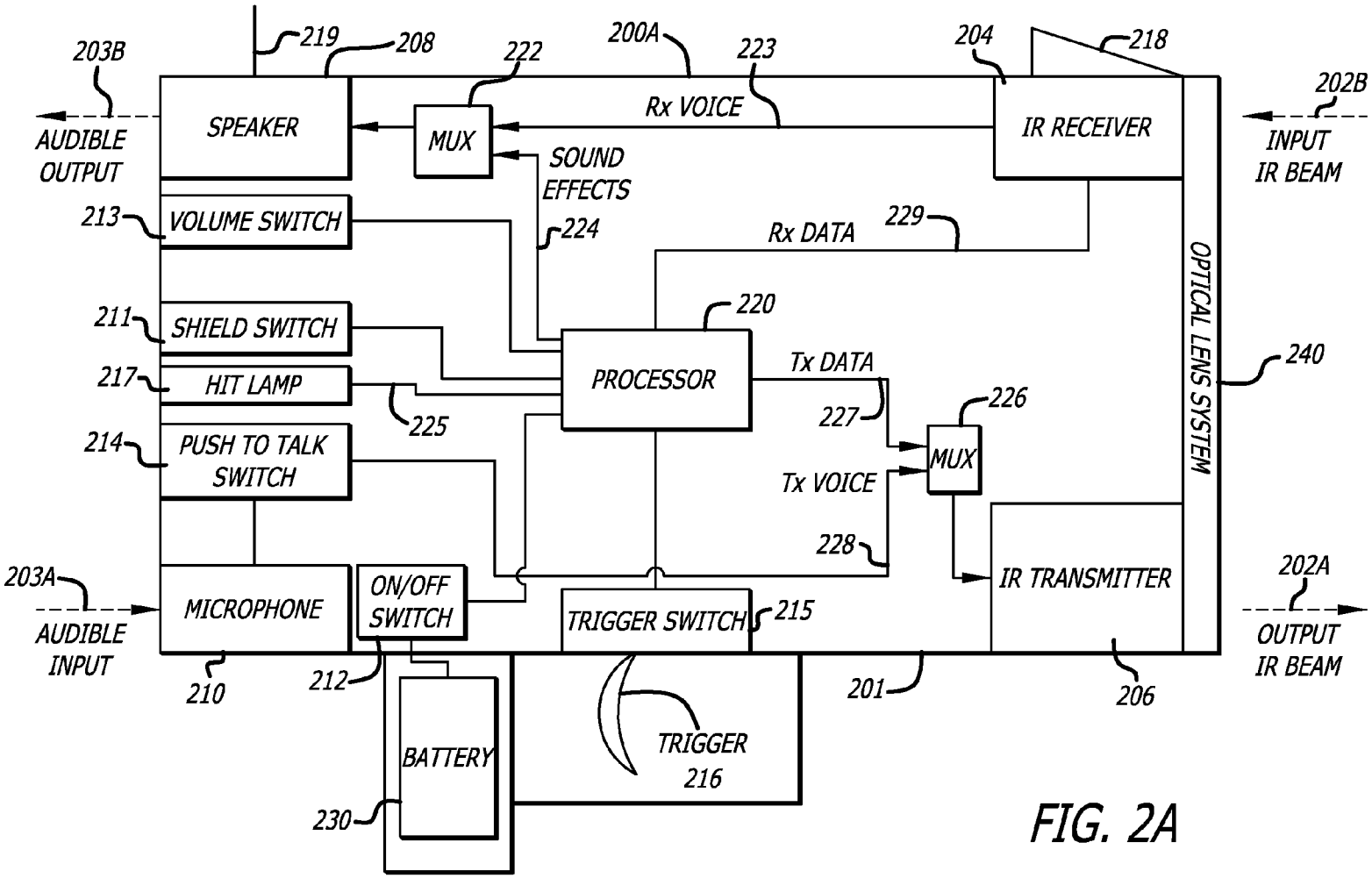
FIG. 2A is a block diagram of a first embodiment of a hand held electronic toy gun (i.e., toy laser tag gun) with integrated data and voice IR communication.

Referring now to FIG. 2A, an embodiment of a toy laser tag gun 200A is illustrated. The toy laser tag gun 200A represents an embodiment of the toy laser tag guns 101A-101C. The toy laser tag gun 200 may be used as a toy for voice and data communication between a pair of users or children as well as a device for playing a laser tag game. Additionally, audible sounds and/or audible voice sounds received by a microphone of one toy laser tag gun may be communicated to and reproduced by another toy laser tag gun. The toy laser tag gun 200A may receive an audible input 203A and can generate an output IR beam 202A in response thereto. The toy laser tag gun 200A may receive an input IR beam 202B and generate an audible output 203B in response thereto. The audible output may be considered audible sound pressure or audible waves having a frequency or wavelength that may be heard by humans.

The toy laser tag gun 200A includes the IR receiver 204, an IR transmitter 206, a speaker 208, a microphone 210, a processor 220, and a power supply or battery 230. The processor 220 may process both audible voice sounds and data signals. The toy laser tag gun 200A may further include one or more of a shield switch 211, an on/off switch 212, a volume switch 213, a talk switch 214, and a trigger switch 215. The toy laser tag bun 200A further includes a housing 201 to hold the components together as a unit.

In the embodiment illustrated of the toy laser tag gun 200A, the IR receiver 204 receives voice and data infrared signals and over the input IR beam 202B. The IR receiver 204 transduces the infrared signals into an electrical signal and demultiplexes the received voice signal 223 from the received data signal 229. The received data signal 229 is coupled into the processor 220. The received voice signal 223 is coupled to the speaker 208 through the multiplexing means or the multiplexer 222.

Electronic voice signals and data signals within the toy laser tag gun may be coupled together into the speaker 208 and the IR transmitter 206 in a number of ways in order to reduce component count and costs. The transmit voice signal 228 and the transmit data signal 227 are multiplexed together so each may drive the IR transmitter 206. The received voice signal 223 and the sound effects signal 224 are multiplexed together so each may drive the speaker 208. This function is indicated by the multiplexers 222 and 226. In one embodiment, the multiplexer 222 and/or 226 is a wired-or connection. In another embodiment, the multiplexer 222 and/or 226 is a pair of transistor drivers with their outputs coupled together. In another embodiment, multiplexer 222 and/or 226 may be an operational amplifier to multiplex the signals together as one output.

In a configuration as a toy gun, the toy laser tag gun 200A may further include a trigger 216, a bead 218, a sight 219, and the housing 201 in the shape of a gun body or stock. Alternatively, the gun sight (i.e. the bead 218 and the sight 219) may be replaced by a scope that provides target magnification and cross hairs. The trigger 216 is coupled to the trigger switch 215 in order to actuate the processor 220 to fire a tag at an opponent in the laser tag gaming system. The shield switch 211, the trigger switch 215, and the hit lamp 217 are provided in order to play a laser tag game. The hit lamp 217 may be one or more indicator lights in order to indicate various values that one may have during the game. The hit lamp 217 may also be replaced with more sophisticated indicators such as a light emitting diode (LED) display or a liquid crystal display (LCD) panel. The talk switch 214 is coupled to the microphone 210 and couples to the IR transmitter 206 through the multiplexer 226. In this manner the audible input 203 may be transduced into an IR output signal on the output IR beam 202A. An IR voice signal input over the input IR beam 202B may be transduced from an IR signal into an electrical signal 223 and then an audible output 203B by the IR receiver 204 coupling through the multiplexer 222 to the speaker 208. An IR data signal on the input IR beam 202B may be received by the IR receiver 204 and transduced from an IR signal into an electrical signal 229. The electrical signal 229, referred to herein as the received data signal 229, is coupled into the processor 220. The processor processes the received data signal 229, typically a tag, and controls the hit lamp 217 in response to the shield switch 211 and the representative received tag or data in accordance with the laser tag game rules.

In operation, an audible input 203A, such as an audible sound or audible voice sound, is coupled into the microphone 210. The microphone 210 generates an electrical signal which can be amplified. If the talk switch 214 is selected then the amplified electrical signal from the microphone 210, referred to as the transmit voice signal 228, is coupled through the multiplexer 226 into the IR transmitter 206. The IR transmitter 206 generates an infrared voice signal in response which is transmitted as the output IR beam 202A.

The toy laser tag gun 200A may further include an optical lens system 240 to focus the IR light beams into the IR receivers and out of the IR transmitters. The optical lens system 240 may include one or more lenses and a filter. The filter may bandpass light in the IR spectrum and filter out other stray light sources. The function of the one or more lenses of the optical lens system 240 is described further below.

An IR voice signal on the input IR beam 202B may be coupled into the IR receiver 204. The IR receiver 204 transduces the infrared signal into an electrical signal, referred to as the received voice signal 223. The received voice signal 223 is coupled to the speaker 208 through the multiplexer 222. The speaker 208 transduces the received voice signal 223 into an audible output 203B.

An IR data signal on the input IR beam 202B may be coupled into the IR receiver 204. The IR receiver 204 transduces the IR data signal on the input IR beam 202B into an electrical signal, referred to as the received data signal 229. The received data signal 229 can be coupled into the processor 220.

The processor 220 may generate a transmit data signal 227 in response to the trigger switch 215 or some other switch or control mechanism. The transmit data signal 227 is coupled to the IR transmitter 206 through the multiplexer 226. The IR transmitter 206 can generate an IR data signal in response which is transmitted as the output IR beam 202A.

The processor 220 may also generate a sound effects data signal 224, an electrical signal, which is coupled to the speaker 208 through the multiplexer 222. The speaker 208 transduces the sound effects data signal 224 into an audible output 203B.

In order to supply power to electrical components, the positive terminal of the power supply or battery 230 is coupled to one pole of the on/off switch 212. The opposite pole of the on/off switch 212 is coupled to the power supply node or bus which is coupled to a number of the electrical components, including the processor 220. The negative or ground terminal of the power supply or battery 230 is coupled to a ground plane or bus. Detailed electrical connections are further discussed below with respect to FIG. 4.

Figure 2B:
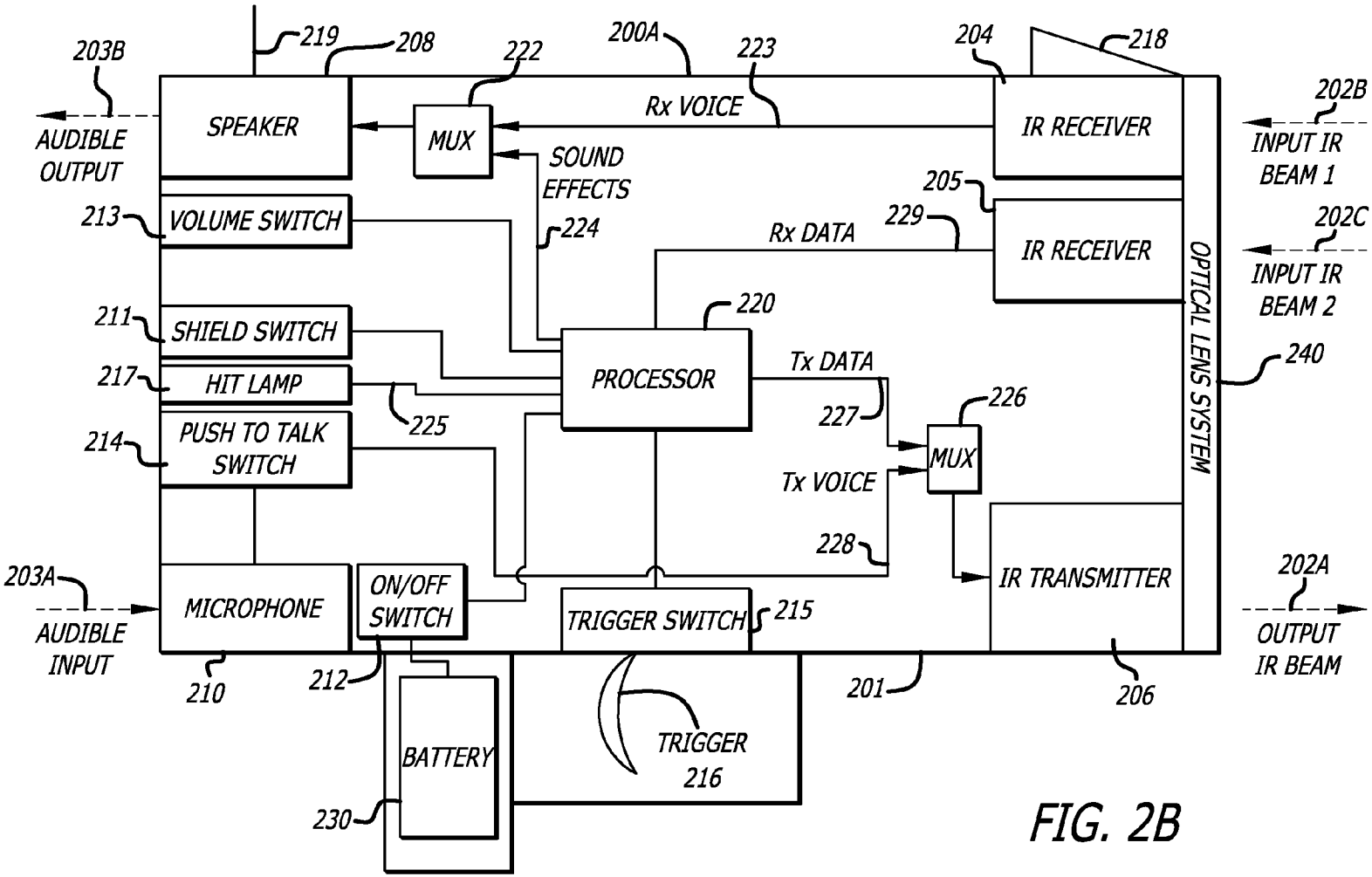
FIG. 2B is a block diagram of another embodiment of a hand held electronic toy gun (i.e., toy laser tag gun) with integrated data and voice IR communication.

Referring now to FIG. 2B, a toy laser tag gun 200B is illustrated. The toy laser tag gun 200B differs from the toy laser tag gun 200A in that it includes two IR receivers to separately receive IR data signals and IR voice signals. The toy laser tag gun 200B may receive an audible input 203A and generate an output IR beam 202A in response thereto. The toy laser tag gun 200B may receive an input IR beam 202B and an input IR beam 202C and may generate an audible output 203B in response thereto.

In one embodiment, the IR voice signals are transmitted at baseband without using a carrier signal while the IR data signals are transmitted using a carrier signal. Each of the IR receivers may be optimized for receiving the desired signal frequencies and amplitudes. The toy laser tag gun 200B includes the IR receiver 204 and a second IR receiver 205 for receiving IR voice signals over an input IR beam 202B and IR data signals over an input IR beam 202C respectively. Otherwise, the toy laser tag gun 200B further includes same numbered components of the toy laser tag gun 200A previously described with reference to FIG. 2A and will not be repeated here again for reasons of brevity.

The IR receiver 204 transduces an IR voice signal from the input IR beam 202B into an electrical signal, referred to as the received voice signal 223. The received voice signal 223 is coupled to the speaker 208 through the multiplexer 222. The received voice signal 223 is transduced by the speaker 208 into an audible output 203B.

The IR receiver 205 may receive an IR data signal over the input IR beam 202C. The IR receiver 205 transduces the IR data signal into an electrical signal, referred to as a received data signal 229. The received data signal 229 is coupled to the processor 220.

Figure 2C:
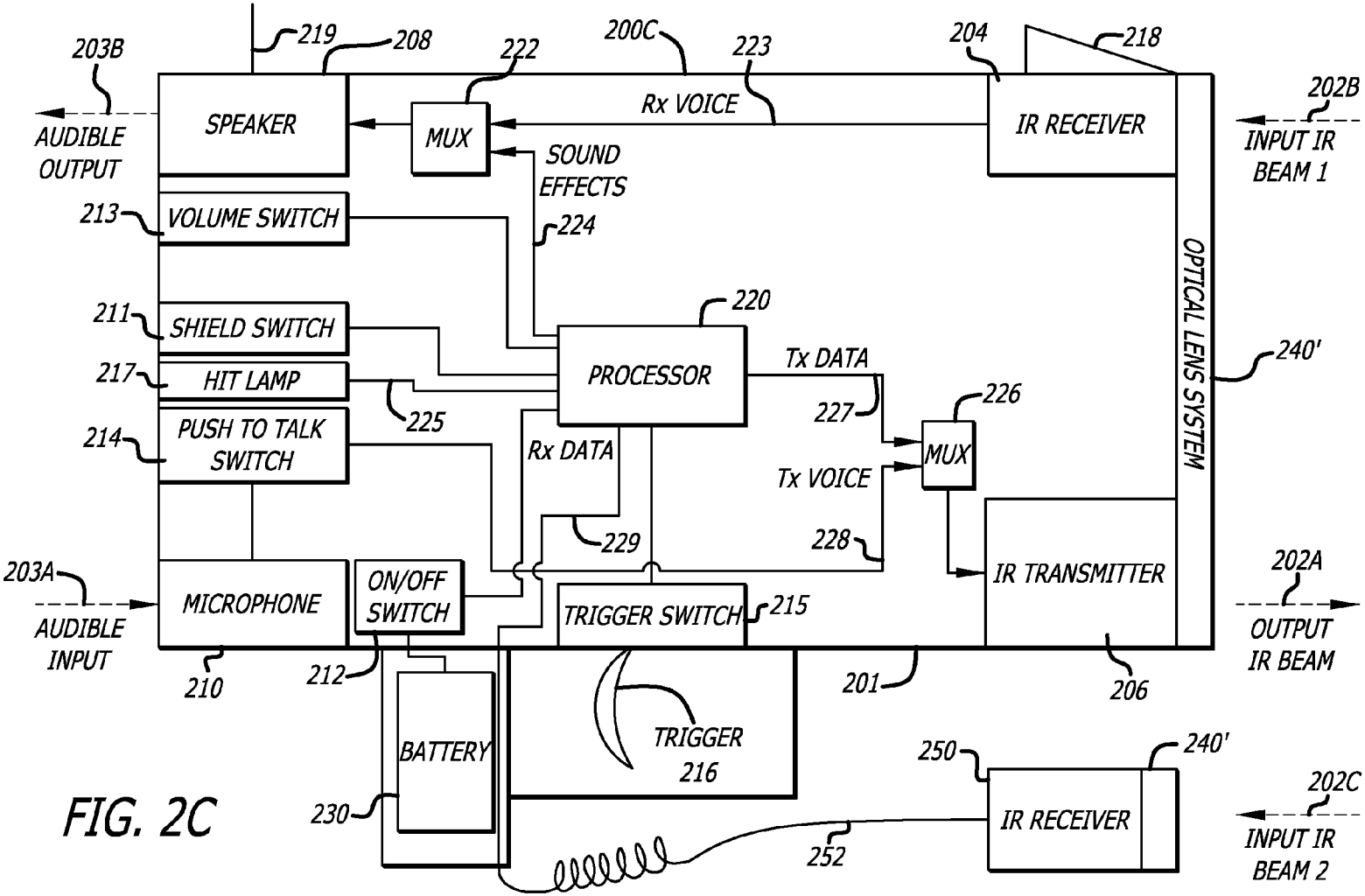
FIG. 2C is a block diagram of another embodiment of a hand held electronic toy gun (i.e., toy laser tag gun) with integrated data and voice IR communication.

Referring now to FIG. 2C, another embodiment of the toy laser tag gun 200C coupled to an external IR receiver or target 250 is illustrated. The toy laser tag gun 200C differs from the toy laser tag gun 200B in that one of the two IR receivers is physically external to the laser tag gun 200C but electrically coupled together. The toy laser tag gun 200C may receive an audible input 203A and generate an output IR beam 202A in response thereto. The toy laser tag gun 200C may receive an input IR beam 202B and an input IR beam 202C and may generate an audible output 203B in response thereto.

A cable 252 electrically couples the toy laser tag gun 200C and the IR receiver 250 together. In one embodiment, the IR receiver 250 may receive only IR data signals. In another embodiment, the IR receiver 250 may receive both IR data signals and IR voice signals. The IR receiver 250 may be worn by an end user and provide a larger reception area to improve IR communication between a pair of toy laser tag guns.

The IR receiver 204 may transduce an IR voice signal over the input IR beam 202B into an electrical signal, referred to as the received voice signal 223. The received voice signal 223 is coupled to the speaker 208 through the multiplexer 222. The voice signal 223 is transduced by the speaker 208 into an audible output 203B.

The IR receiver 250 may receive an IR data signal over the input IR beam 202C. The IR receiver 250 may transduce the IR data signal into an electrical signal, referred to as a received data signal 229. The received data signal 229 is coupled to the processor 220.

Otherwise, the toy laser tag gun 200C further includes the components of the toy laser tag guns 200A-200B previously described with reference to FIGS. 2A and 2B having the same reference numbers and will not be repeated here again for reasons of brevity.

Figure 2D:
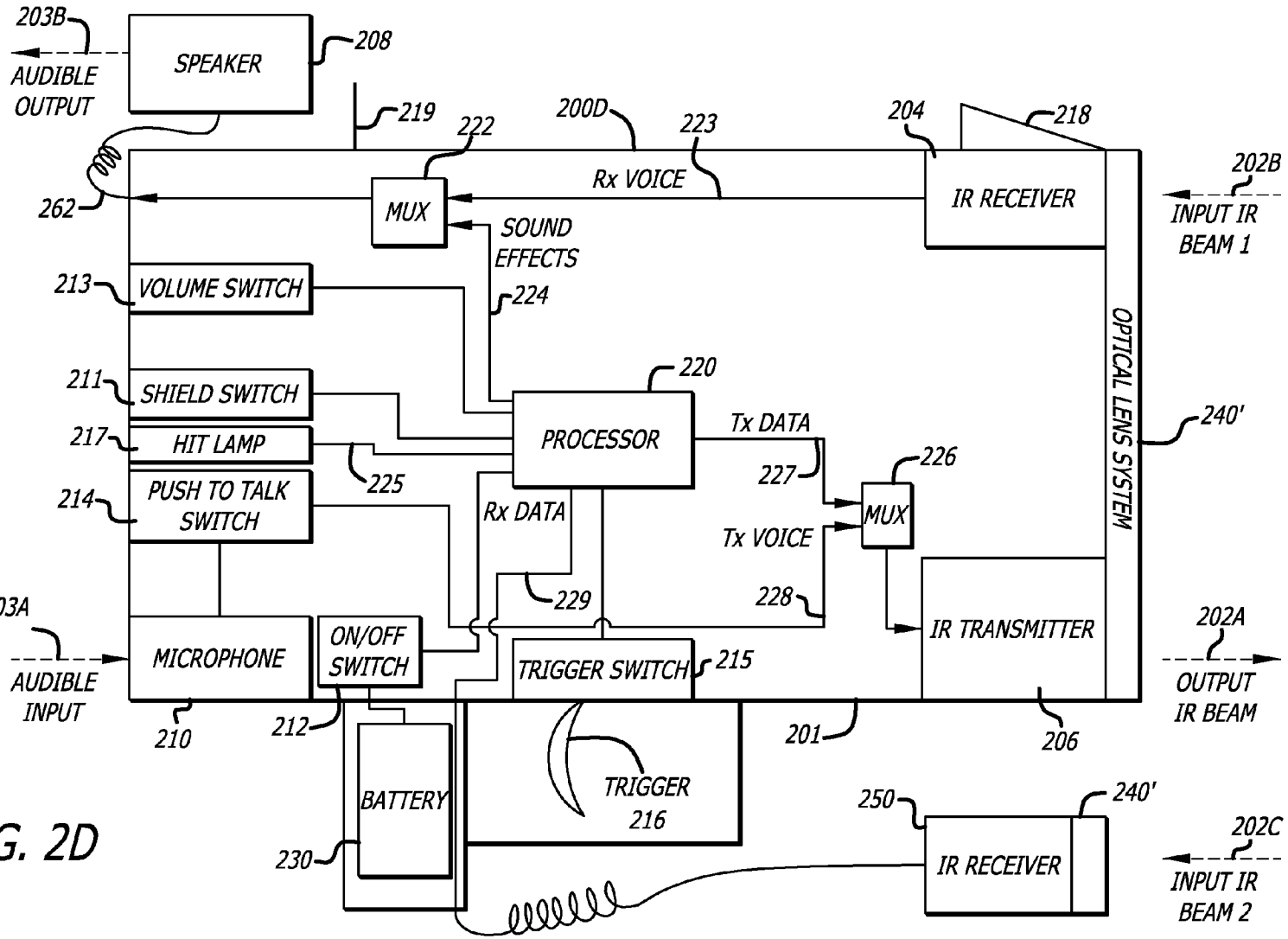
FIG. 2D is a block diagram of another embodiment of a hand held electronic toy gun (i.e., toy laser tag gun) with integrated data and voice IR communication.

Referring now to FIG. 2D, a toy laser tag gun 200D which is a variation of the toy laser tag guns 200A-200C is illustrated. In the toy laser tag gun 200*d*, the speaker 208 is located externally but electrically coupled thereto as part of a head set, head phones, or head gear. The speaker 208 may be electrically coupled to the toy laser tag gun 200D by means of a wired connection 262 as illustrated or by means of a wireless connection using RF or IR signals. Additionally, the external IR receiver 205 in FIG. 2D, as was discussed with reference to FIG. 2C, may be separately worn on the body of a user or alternatively combined with the external speaker 208 in the head set, head phones, or head gear. Otherwise, the toy laser tag gun 200D further includes the components of the toy laser tag guns 200A-200C previously described with reference to FIGS. 2A-2C having the same reference numbers and will not be repeated here again for reasons of brevity.

While the toy laser tag guns 200A-200D are coupled or include an IR receiver for receiving voice and/or data signals, the IR receiver may be a separate disconnected component that is utilized with the toy laser tag guns.

Figure 2E:
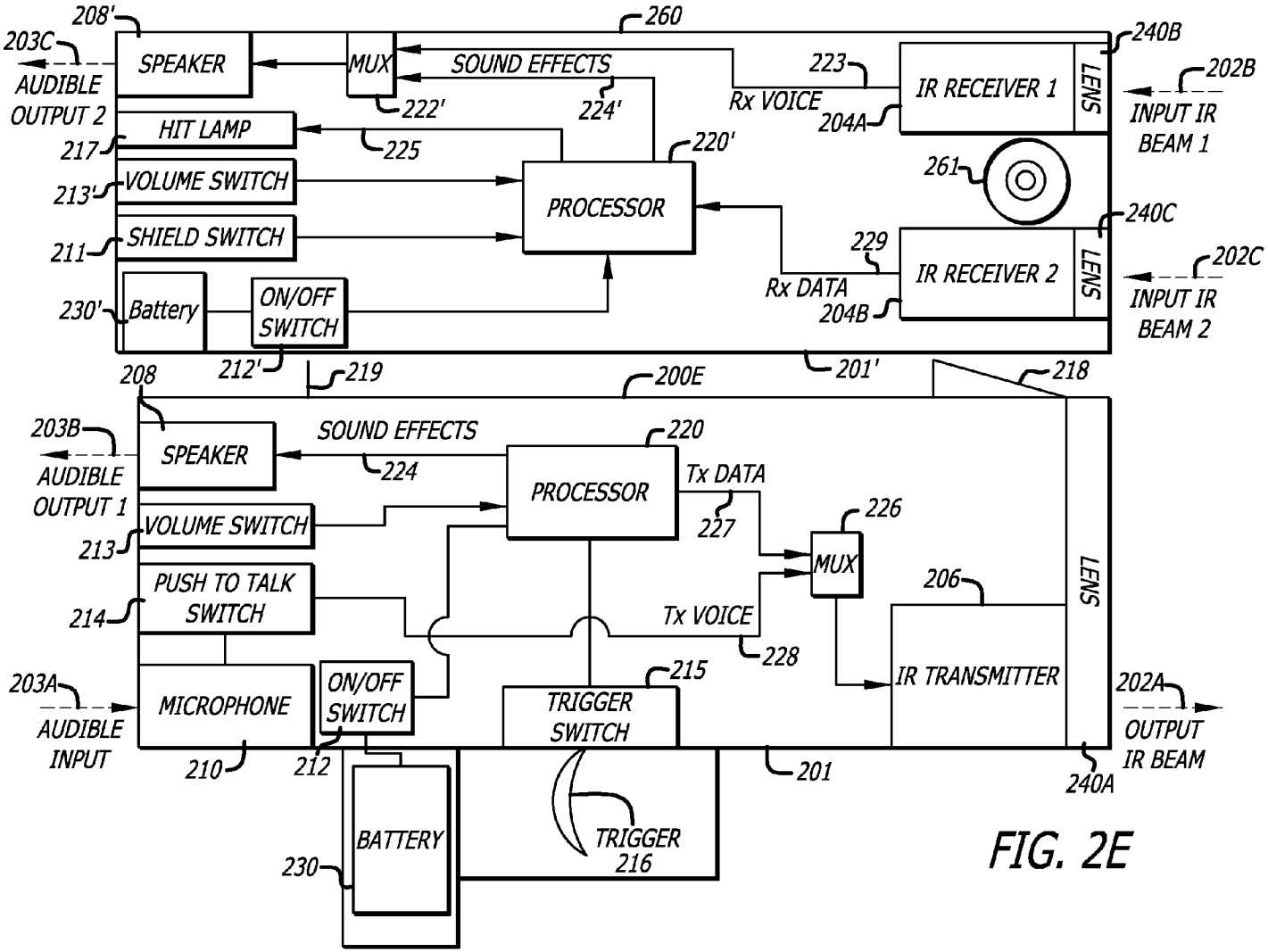
FIG. 2E is a block diagram of another embodiment of a hand held electronic toy gun (i.e., toy laser tag gun) and a target to provide voice and data IR communication.

Referring now to FIG. 2E, a toy laser tag gun 200E and a target 260 are illustrated. The target 260 is typically worn or attached to a user whom also carries the toy laser tag gun 200E. In an alternative embodiment, the target 260 may be used for target practice and located away from the user with the toy laser tag gun 200E. In a toy laser tag game system, each user would typically have both the laser tag gun 200E and the target 260. Alternatively, the embodiments of FIGS. 2A-2E may be mixed in a field of toy laser tag play.

The target 260 may include a bull's-eye 261 or other indicia coupled to the exterior of a housing 201' to indicate where to aim a toy laser tag gun to make a hit or strike. The target 260 includes the housing 201', a processor 220', a first IR receiver 204A, a second IR receiver 204B, a speaker 208', a hit lamp 217, a volume switch 213', a shield switch 211, an on/off switch 212', and a battery 230' coupled together as illustrated in FIG. 2E. The on/off switch 212' selectively provides power from the battery 230' to the electrical components of the target 260.

The target 260 may receive two infrared beams, a first input infrared beam 202B and a second input infrared beam 202C. The target 260 may generate audible sounds, such as voice or sound effects as the audible output 203C, as well as visual light effects, such as the light generated by the hit lamp 217.

The first IR receiver 204A transduces voice signals on the first input infrared beam 202B into electrical signals as the received voice signal 223. The second IR receiver 204B transduces data signals on the second input infrared beam 202C into electrical signals as the received data signal 229. One or more lenses 240B and 240C focus the infrared input beams 202B and 202C into the respective IR receivers 204A and 204B.

The processor 220' processes information from the shield switch 211 and the received data signals 229 to selectively generate the hit signal 225 and turn on the hit lamp 217 and/or generate a sound effects signal 224'. The sound effects signal 224' and the received voice signal 223 are multiplexed into the speaker 208' by a multiplexer 222'. The speaker 208' transduces the electrical signals of both the sound effects signal 224' and the received voice signal 223 into an audible output 203C.

The toy laser tag gun 200E is a variation of the toy laser tag guns 200A-200D. The toy laser tag gun 200E may or may not include an infrared receiver. In the case with no infrared receiver, voice signals will not be generated by the toy laser tag gun 200E, relying on the target 260 to provide audible voice in response to receiving infrared signals. The toy laser tag gun 200E and the processor 220 need not process tag information received over an infrared signal. The toy laser tag gun 200E still processes voice and sound input of the audible input 203A for transmission over the output IR beam 202A.

The toy laser tag gun 200E includes the IR transmitter 206, the speaker 208, the microphone 210, the processor 220, and the power supply or battery 230. To collimate infrared signals of the IR transmitter 206, the laser tag gun 200E includes the lens 240A to generate the IR output beam 202A. The toy laser tag gun 200E may further include one or more of the on/off switch 212, the volume switch 213, the talk switch 214, and the trigger switch 215. The toy laser tag bun 200E further includes the housing 201 to hold the components together as a unit. In a configuration as a toy gun, the toy laser tag gun 200E may further include a trigger 216, a bead 218, a sight 219, and the housing 201 in the shape of a gun body or stock. But for the differences previously described, these components of the toy laser tag gun 200E function similarly to those previously described with reference to FIGS. 2A-2D having the same reference numbers and will not be repeated here again for reasons of brevity.

Figure 2F:
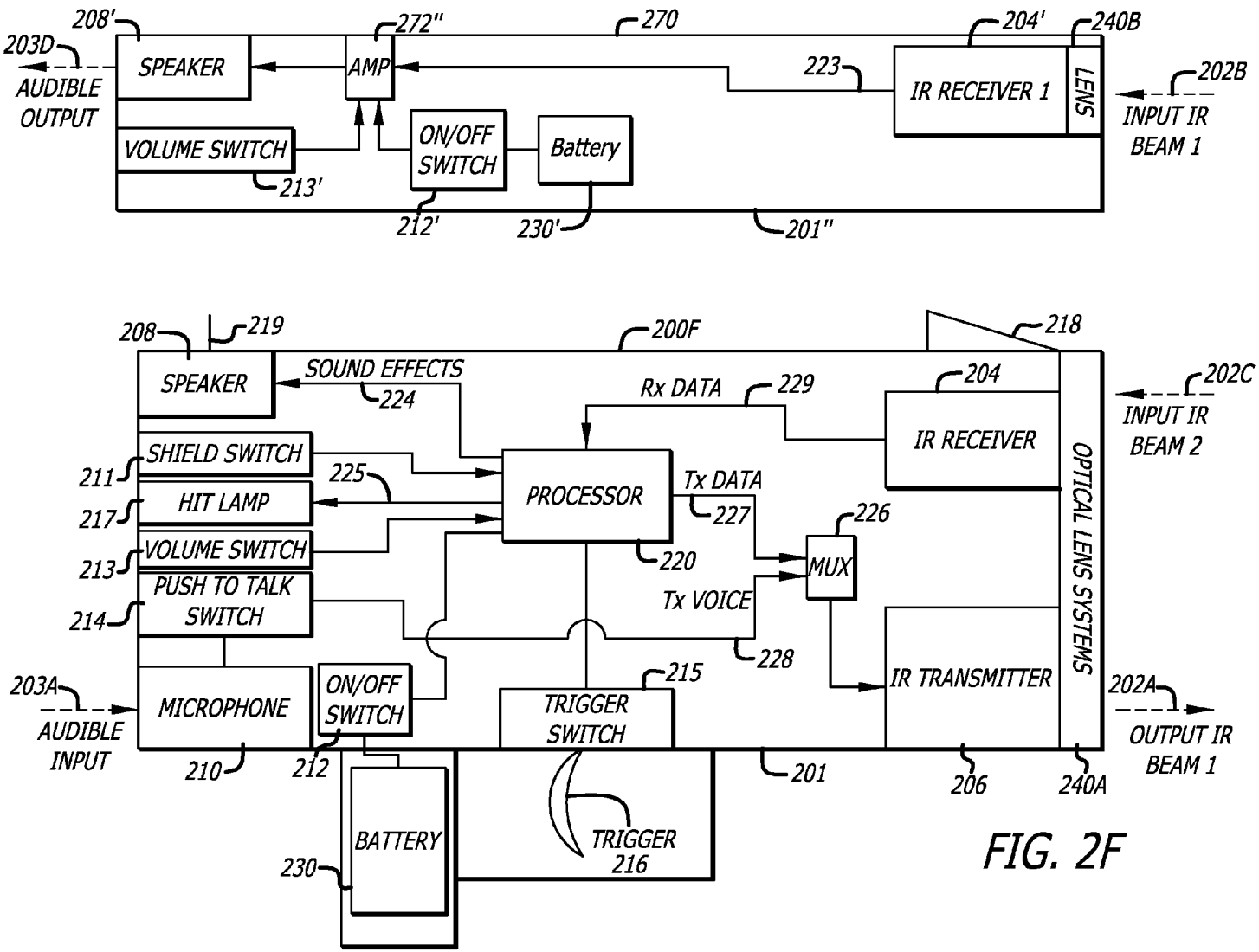
FIG. 2F is a block diagram of another embodiment of a hand held electronic toy gun (i.e., toy laser tag gun) and a sound receiver to provide voice and data IR communication.

Referring now to FIG. 2F, a toy laser tag gun 200F and a sound receiver 270 are illustrated. The sound receiver 270 is typically worn or attached to a user whom also carries the toy laser tag gun 200E. The sound receiver 270 may be a headset for example. The sound receiver 270 can generate audible voice and sounds from the infrared beams it may receive. The toy laser tag gun 200F may have a speaker to generate sound effects. Alternatively, the speaker may be replaced with a wireless transmitter of some form and the receiver may include a matching wireless receiver so that the sound receiver 270 generates the sounds effects of the laser tag gun as well as reproduces the received voices and sounds over the infrared beams. In a toy laser tag game system, each user would typically have both the laser tag gun 200F and the sound receiver 270. Alternatively, the embodiments of FIGS. 2A-2E may be mixed in a field of toy laser tag play.

The sound receiver 270 may include a housing 201", an IR receiver 204', a speaker 208', a volume switch 213', an on/off switch 212', an amplifier 272", and a battery 230' coupled together as illustrated in FIG. 2F. The on/off switch 212' selectively provides power from the battery 230' to the active electrical components of the sound receiver 270, including the amplifier 272". The IR receiver 204' may receive an input IR beam 202B. The input IR beam 202B is the infrared beam which carries voice signals and sounds from another user. The sound receiver 270 may further include a lens 240B to focus the input IR beam 202B into the IR receiver 204'.

The IR receiver 204' transduces voice signals on the first input infrared beam 202B into electrical signals as the received voice signal 223. The amplifier 272" selectively amplifies the amplitude of the received voice signal 223 and couples it into the speaker 208'. The amplifier is responsive to the volume switch 213'. The speaker 208' transduces the electrical signal into an audible output 203D.

The toy laser tag gun 200F may include the IR receiver 204, the IR transmitter 206, the speaker 208, the microphone 210, the processor 220, the multiplexer 226, and the power supply or battery 230. To collimate infrared signals of the IR transmitter 206, the laser tag gun 200F includes the optical lens system 240A to generate the IR output beam 202A. The optical lens system 240A may further focus the input IR beam 202C into the IR receiver 204. The optical lens system 240A functions similar to the optical lens system 240 previously described and which is further described below.

The toy laser tag gun 200F may further include one or more of the on/off switch 212, the volume switch 213, the talk switch 214, and the trigger switch 215. The toy laser tag gun 200F may further include the hit lamp 217 or other type of visual display to inform a user. The toy laser tag gun 200F further includes the housing 201 to hold the components together as a unit. In a configuration as a toy gun, the toy laser tag gun 200F may further include a trigger 216, a bead 218, a sight 219, and the housing 201 in the shape of a gun body or stock. But for the differences previously described, these components of the toy laser tag gun 200F function similarly to those previously described with reference to FIGS. 2A-2E having the same reference numbers and will not be repeated here again for reasons of brevity.

In yet another alternate embodiment, the IR transmitter 206 and the IR receivers 204 and 204' may be replaced with an RF transmitter and RF receivers, respectively. In this manner, the toy laser tag gun 200F communicates wirelessly with the sound receiver 270 using RF signals instead of infrared signals.

Figure 3A:
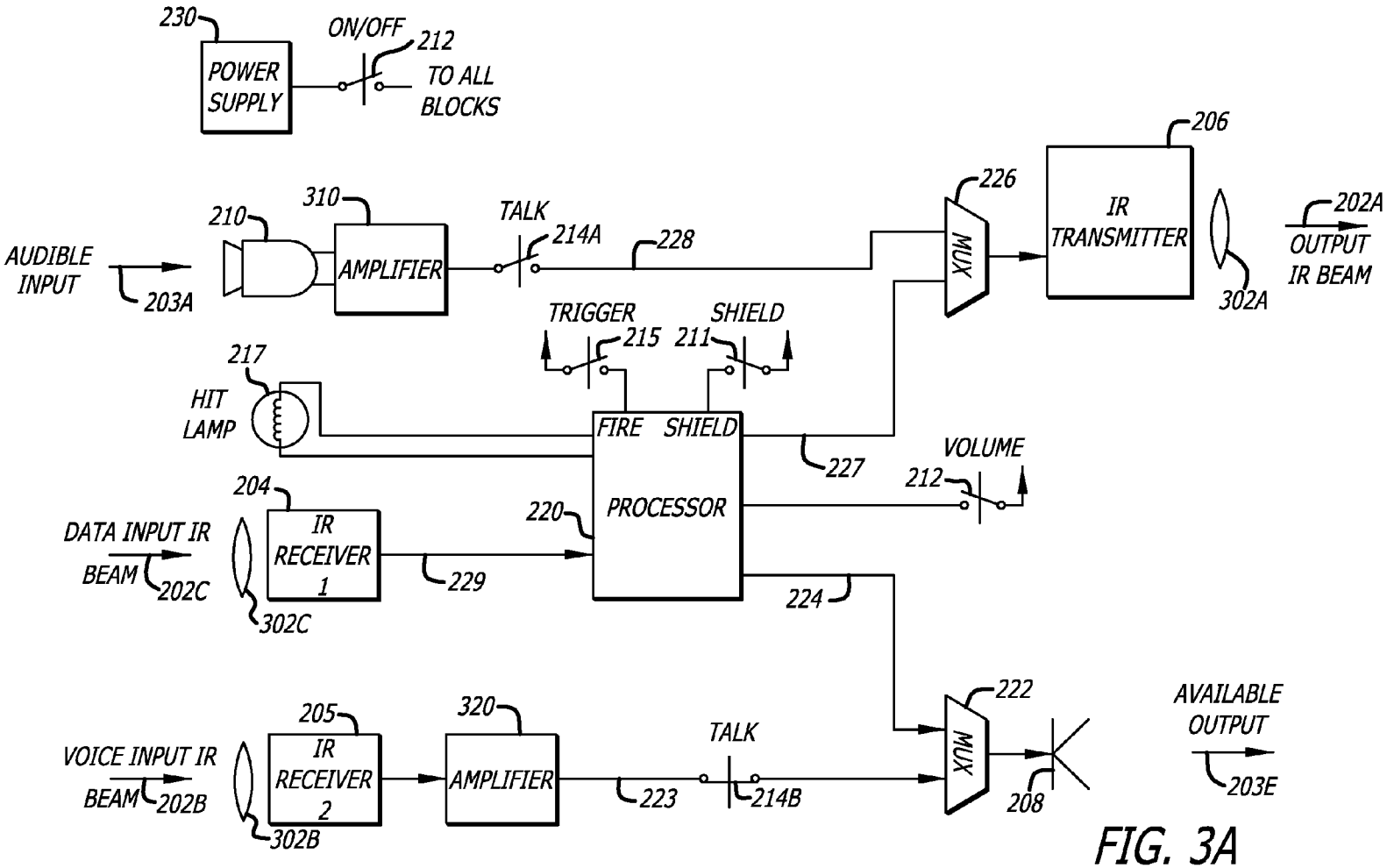
FIG. 3A is a functional block diagram of an embodiment of the hand held electronic toy gun (i.e., toy laser tag gun) with integrated data and voice IR communication.

Referring now to FIG. 3A, a functional block diagram of an embodiment of a toy laser tag gun to transceive voice and data signals is illustrated. FIG. 3A illustrates an exemplary optical lens system which includes one or more lenses 302A, 302B, and 302C. An IR data signal on an input infrared beam 202C is focused by the lens 302C into the IR receiver 204. An IR voice signal on an input infrared beam 202B is focused by the lens 302B into the IR receiver 205. If a single IR receiver is used in the toy laser tag gun, then one of the lenses 302A and 302B may be utilized. IR voice and data signals, generated by an IR radiating point source provided by the IR transmitter 206, are focused by the lens 302A into a collimated beam of the output IR beam 202A.

The IR receiver 204 transduces the IR data signal on the input IR beam 202C into the received data signal 229 which is coupled to the processor 220. The IR receiver 205 transduces the IR voice signal on the input IR beam 202B into an electrical signal which is coupled into the amplifier 320 to generate the received voice signal 223. The processor 220 may generate a sound effects signal 224.

The talk switch 214B is normally closed so that the received voice signal 223 is normally coupled through the multiplexer 222 to the speaker 208. The sound effects signal 224 couples to the speaker 208 through the multiplexer 222 as well. The volume switch 212 may be coupled to the processor 220 to control the loudness of sounds generated by the speaker 208. The volume switch 212 couples signals to the processor 220 which may raise or lower the amplitude of the sound effects signal 223 generated by the processor and the amplification provided by the amplifier 320. The speaker 208 transduces the electrical signal of the sound effects signal 224 and the receive voice signal 223 into sound indicated by the audible output 203B.

The audible input 203A may be coupled into the microphone 210 of the toy laser tag gun and transduced into an electrical signal which is amplified by the amplifier 310 and coupled to a terminal or pole of the talk switch 214A. The talk switch 214 is normally open but may be depressed in order to couple the amplified signal from the amplifier to the IR transmitter 206 through the multiplexer 226. When the talk switch 214A is closed the amplified electrical signal from the amplifier 310 becomes the transmit voice signal 228. The processor may generate a transmit data signal 227 to transmit data to another toy laser tag gun. The transmit data signal 227 may be responsive to the trigger switch 215 being closed, for example.

The transmit data signal 227 and transmit voice signal 228 are coupled to the IR transmitter 206 through the multiplexer 226. The IR transmitter 206 transduces the electrical signal of the transmit data signal 227 and transmit voice signal 228 into an IR voice signal and an IR data signal on the output IR beam 202A.

The hit lamp 217, the trigger switch 215 and the shield switch 211 are coupled to the processor 220 for playing a laser tag game. The hit lamp 217 may be replaced with a more sophisticated display mechanism to provide more information to a user. The trigger switch 215 when closed may signal the processor 220 to fire or generate a data tag for transmission on the output IR beam 202A. The shield switch 211 when closed may signal the processor 220 to ignore any received data tags over an input IR beam 202C for a period of time. That is, the shield switch 211 may deter the recognition of a received data tag by the processor 220.

To provide power to the toy laser tag gun, a power supply or battery 230 is coupled to one terminal of the on/off switch 212. The power connections of the other electronic blocks couple to the second terminal of the on/off switch 212 in order to receive power.

The multiplexers 226 and 222 may be a wired-or connection an operational amplifier to combine signals, or other known means of combining signals.

Figure 3B:
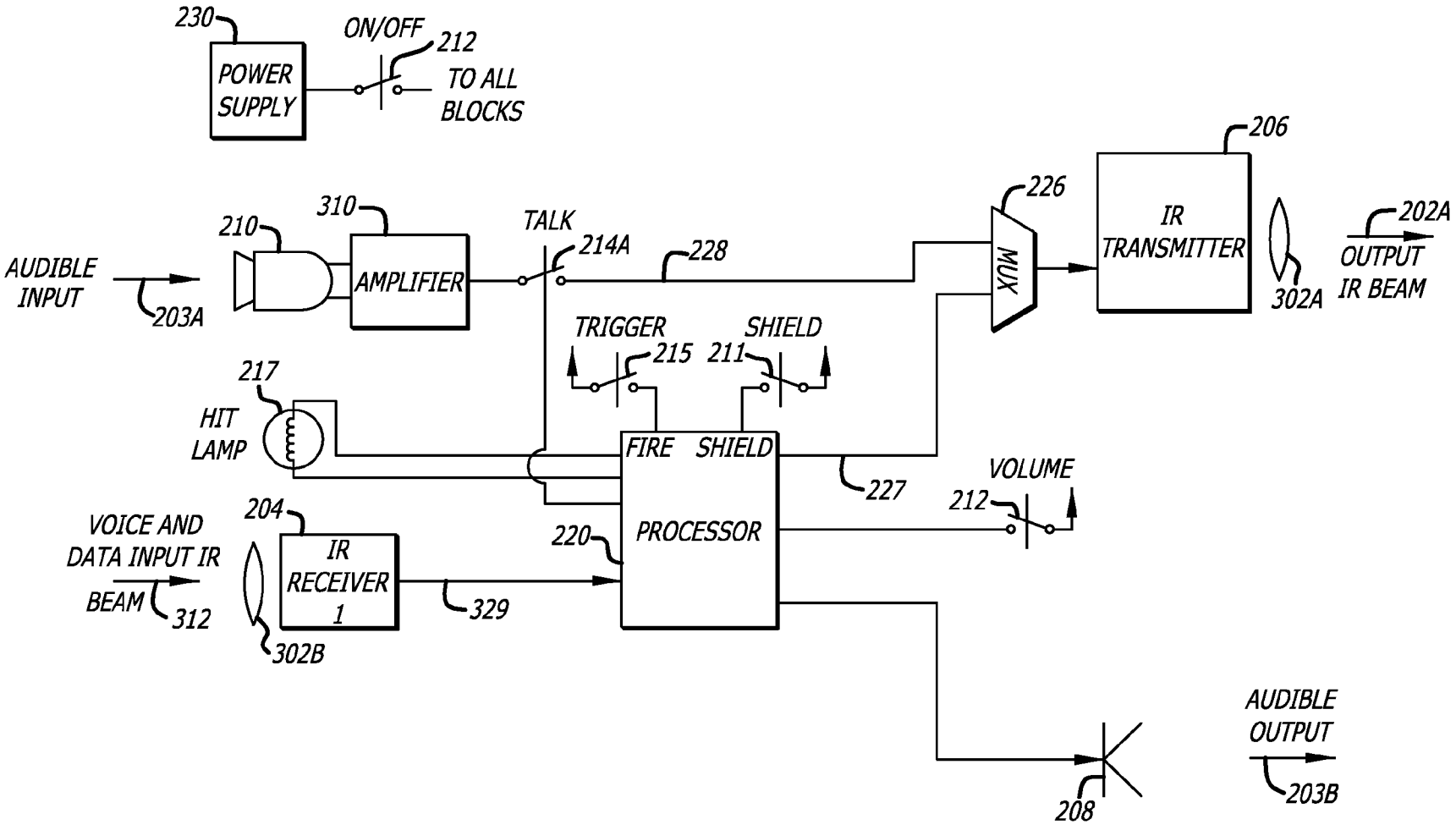
FIG. 3B is a functional block diagram of another embodiment of the hand held electronic toy gun (i.e., toy laser tag gun) with integrated data and voice IR communication.

Referring now to FIG. 3B, an alternate functional block diagram for an embodiment of a toy laser tag gun for transceiving voice and data by means of IR communication channels is illustrated. In this embodiment, a single IR receiver 204 and a single transmitter 206 are utilized for IR voice signal and IR data signal communication over the input IR beam 312 and the output IR beam 202A.

In FIG. 3B, IR voice signals and IR data signals on the input IR beam 312 may be coupled into the IR receiver 204. The IR receiver 204 transduces the IR voice and IR data signals into electrical signals as received voice/data signals 329. The received voice/data signals 329 are then coupled into the processor 220. The processor 220 demultiplexes the received voice signals from the received data signals and may couple the received voice signals to the speaker 208. The speaker 208 transduces the electrical signal of the received voice signals into an audible output 203B. With the one IR receiver 204, one lens 302B may be used to focus the IR light into an IR photodiode.

The talk switch 214A is normally open. Closing, switching or depressing the talk switch 214A couples electrical signals amplified by amplifier 310 to the IR transmitter 206 through the multiplexer 226. Additionally, the talk switch 214A may be used to couple a talk signal to the processor 220. That is, when the talk switch 214A is closed, the processor 220 may be signaled in order to disable voice signals from being coupled into the speaker 208 in order to reduce feedback.

The volume switch 212 is coupled to the processor 220. The volume switch 212 may signal the processor 220 to lower the amplitude of the voice signals and the sound effect signals coupled to the speaker 208.

Otherwise, the embodiment of the functional blocks illustrated in FIG. 3B are the same as those described and shown in FIG. 3A having the same reference numbers and functionality and will not be repeated here again for reasons of brevity.

Figure 3C:
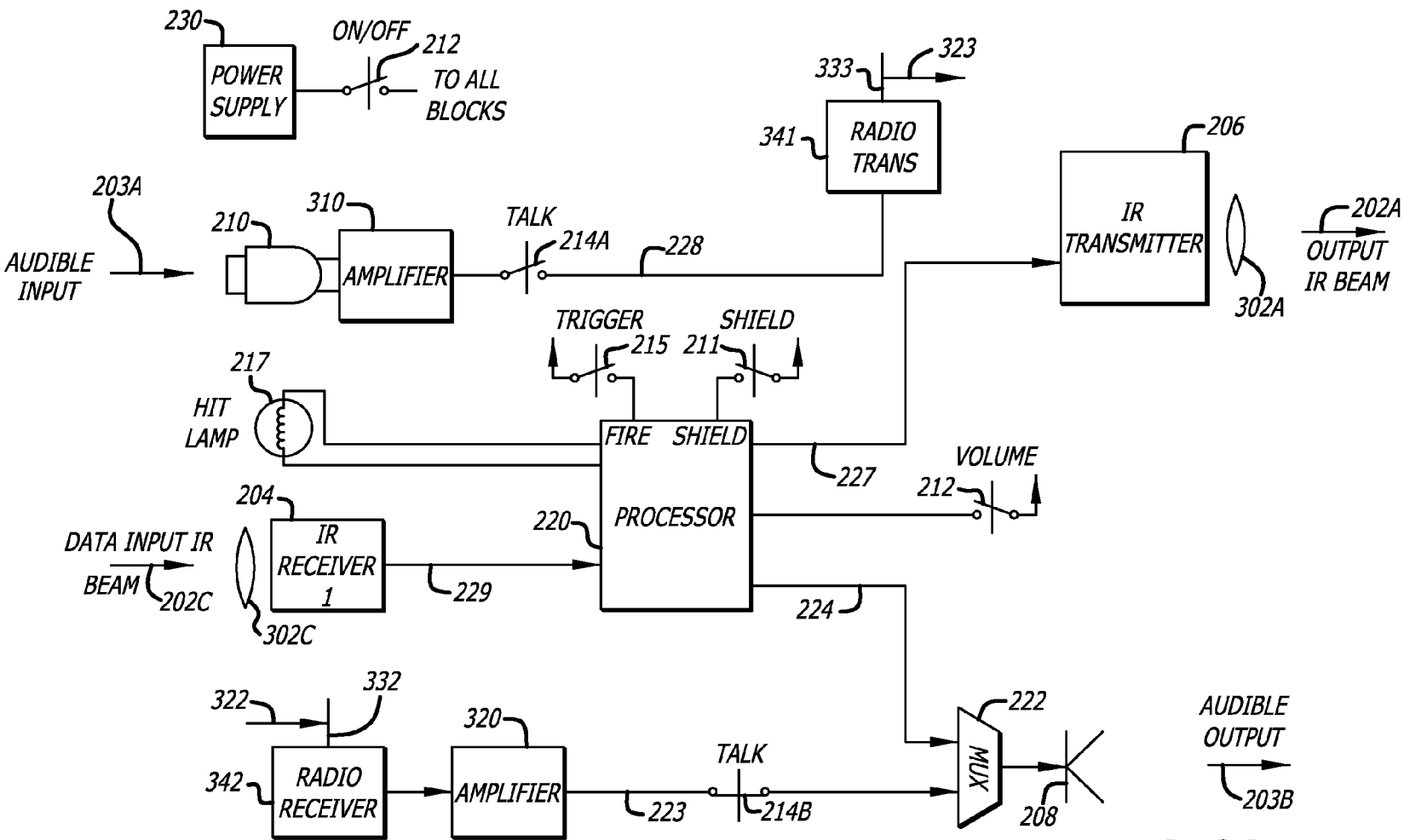
FIG. 3C is a functional block diagram of another embodiment of the hand held electronic toy gun (i.e., toy laser tag gun) with data IR communication and voice RF communication.

Referring now to FIG. 3C, an alternate functional block diagram for an embodiment of a toy laser tag gun for transceiving voice by means of radio frequency (RF) communication channels and data by means of IR communication channels is illustrated. In this embodiment, a single IR receiver 204 and a single transmitter 206 are utilized for IR data signal communication over the input IR beam 202C and the output IR beam 202A. An RF or radio receiver 342 and an RF or radio transmitter 341 are utilized for RF voice signal communication over an incoming RF or radio signal 322 and an outgoing RF or radio signal 323.

An antenna 332 coupled to the RF or radio receiver 342 receives the RF or radio signal 322. The radio receiver 342 additionally couples to the amplifier 320 in order to generate the received voice signal 223.

An antenna 333 coupled to the RF or radio transmitter 341 transmits the RF or radio signal 323. The radio transmitter 341 additionally couples to one pole or terminal of the switch 214A to receive the transmit voice signal 228.

The radio transmitter 341 may transmit the transmit voice signals 228 by modulation over various transmit center carrier radio frequencies. Amplitude modulation (AM) or frequency modulation (FM) may be used to modulate the transmit voice signals onto a selected transmit center carrier radio frequency.

The radio receiver 342 may receive RF signals 322 and demodulate the base band signal from a modulated RF signal 322 at various receive center carrier radio frequencies. The radio receiver 342 may demodulate amplitude modulated (AM) or frequency modulated (FM) signals at a selected receive center carrier radio frequency.

In one embodiment for example, the center transceiver (transmit/receive) carrier radio frequencies are those for walkie-talkies such as 27 MegaHertz (Mhz) or 49 Mhz. In another embodiment for example, the center transceiver carrier radio frequencies are those for the family radios (FRS) on the FRS radio frequency bands specified by the Federal Communication Commission (FCC). Other center transceiver radio frequencies may be used as well.

In an alternate embodiment, the antennas 332 and 333 may be one antenna shared by the radio receiver 342 and the radio transmitter 341. In yet another alternate embodiment, the radio receiver 342 and the radio transmitter 341 may be combined into an RF or radio transceiver which is coupled to one antenna.

Otherwise, the embodiment of the functional blocks illustrated in FIG. 3C are the same as those described and shown in FIG. 3A having the same reference numbers and functionality and will not be repeated here again for reasons of brevity.

Figure 4:
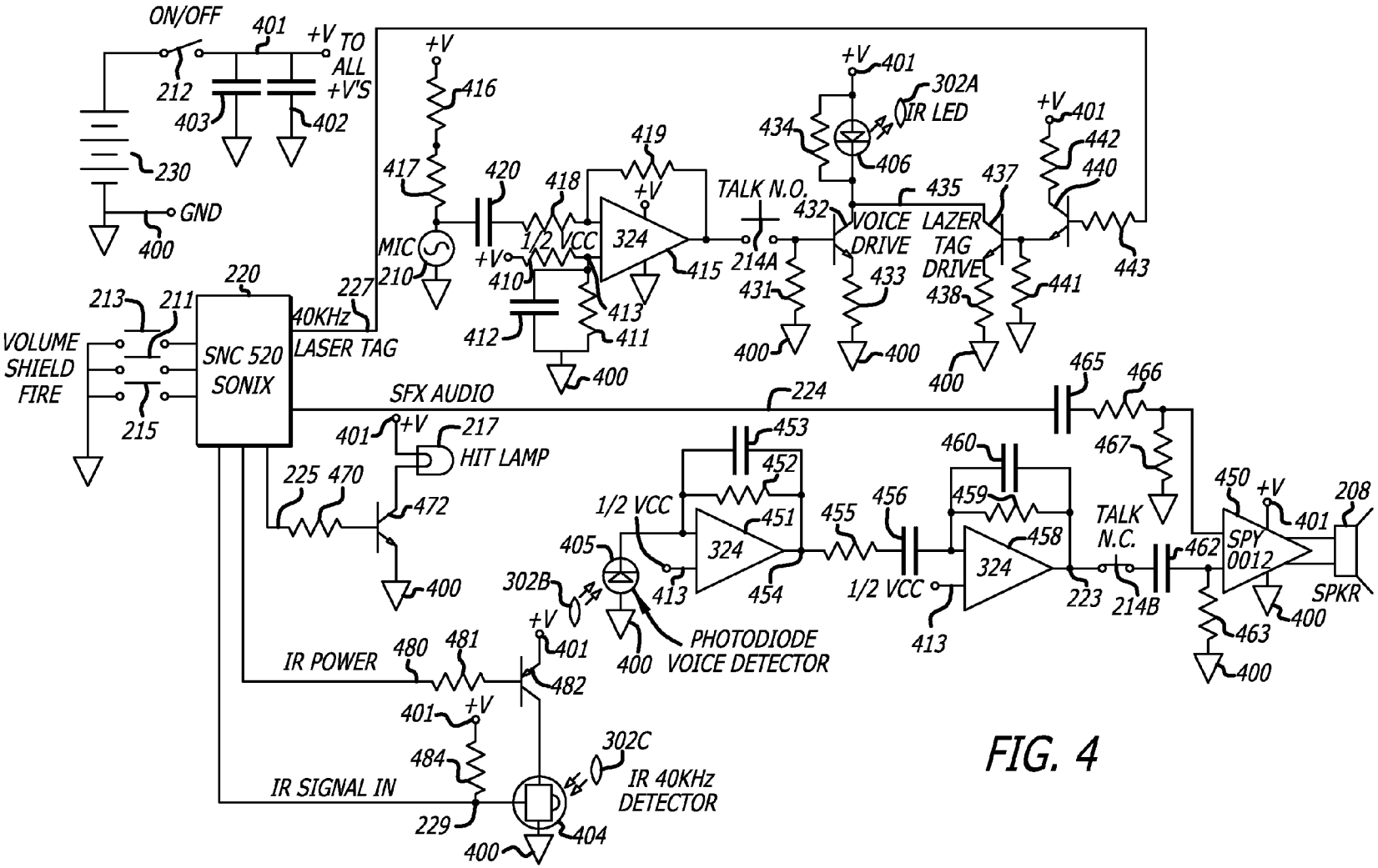
FIG. 4 is a schematic diagram of the components of an embodiment of the hand held electronic toy gun (i.e., toy laser tag gun) with integrated data and voice IR communication.

Referring now to FIG. 4, a detailed schematic diagram of an embodiment of the toy laser tag gun is illustrated including the optical, the electronic and the opto-electronic components utilized and how they are coupled together. The toy laser tag gun includes an IR photodiode 404 (sometimes referred to as an IR detector), an IR photodiode 405, a speaker 208, an IR LED 406, and the microphone 210 to provide both voice and data communication. The IR detector 404 is for receiving an IR data signal. The IR photodiode 405 is for receiving a IR voice signal. The IR LED 406 is for transmitting both an IR voice signal and an IR data signal. The microphone 210 is for receiving audible sounds including an end users voice. The speaker 208 is for generating audible sounds including the recreation of another end users voice.

The lenses 302B and 302C are for focusing IR light of the input IR beams 202B and 202C into the IR photodiodes 404 and 405, respectively. The lens 302A is for focusing IR light out of the IR LED 406 into the output IR beam 202A. The functionality of the one or more lenses of the optical lens system 240 is further described below with reference to FIGS. 5A-5C.

For the laser tag game, the toy laser tag gun further includes the shield switch 211, the fire or trigger switch 215, and the hit lamp 217. To control the amplitude of the speaker 208, a volume switch 213 is coupled to the processor 220.

A pole of the on/off switch 212 is coupled to a positive terminal of the battery 230 while the opposite pole is coupled to the positive voltage supply node 401. A pair of filtering capacitors 402, 403 are coupled to the power supply node 401. An opposite terminal of the battery 230 couples to ground 400. Both the positive power supply node 401 and the ground node 400 couple to various electrical components as shown and illustrated in FIG. 4.

A voltage divider formed by resistors 411 and 410, divides the voltage provided by battery 230 in half at node 413. The voltage on node 413 is filtered by a capacitor 412 and coupled to other circuitry in the schematic as illustrated in FIG. 4.

Node 413, having half of the voltage of the power supply of the battery 230, is coupled into one input terminal of the operational amplifier 415. Resistors 416-419 in conjunction with the capacitor 420 and the operational amplifier 415, amplify the signal generated by the microphone 210. The output of the operational amplifier 415 is coupled to one of two poles or terminals of the talk switch 214A.

The talk switch 214A is normally open so that the signals generated by the microphone are only transmitted when the talk button or switch 214A is closed. When the talk switch 214A is closed, the amplified signal from the microphone 210 is coupled to the base of the bi-polar junction transistor (BJT) 432. The resister 431 has one end coupled to the base of the BJT 432 and an opposite end coupled to ground 400. The emitter of the BJT 432 is coupled to ground through a resistor 433.

The collector of the BJT 432 couples to an end of the resistor 434 and an end of the infrared LED 406 at a node 435. The BJT 432 functions to drive the transmit voice signal 228 into the infrared LED 406. An opposite end of the resistor 434 and the infrared LED 406 are coupled to the power supply node 401. The BJT 437 in combination with the BJT 440, functions to drive the transmit data signal 227 into the infrared LED 406. The BJT 437 has its collector coupled to the collector of the BJT 432 at the node 435. In this manner the data signal and the voice signal can be multiplexed together to drive the infrared LED 406 by a wired-or connection. The transmit data signal 227 is coupled to the base of a BJT 440 through resistor 443. A resistor 442 couples between the collector of the BJT 440 and the positive power supply node 401. A resistor 441 couples between ground and the emitter of the BJT 440. BJT 440 in conjunction with BJT 437 functions to drive the node 435 low in order to turn on the IR LED 406, in response to the transmit data signal 227. In one embodiment, the transmit data signal 227 is a 40 kHz laser tag signal.

The sound effects signal 224 and the received voice signal 223 are coupled through circuitry to the inputs of the operational amplifier 450. The output of the operational amplifier 450 couples to the speaker 208. In this manner, the sound effects signal 224 and the received voice signal 223 may be multiplexed to drive the speaker 208.

The received voice signal 223 is generated by amplifying the signal detected by the IR photodiode 405. The output of the IR photodiode 405 is coupled to one of the input terminals of the operational amplifier 451, as previously discussed. The voltage level of half of the power supply voltage at node 413 is coupled into the other input terminal of the operational amplifier 451. The resistor 452 and the capacitor 453 in the feedback path of the operational amplifier 451 provides additional gain and stability to the output signal on node 454. The output 454 is coupled to a series connection of a resistor 455 and a capacitor 456 before reaching the input of the operational amplifier 458. A resistor 459 and capacitor 460 in the feedback path of the operational amplifier 458 provides additional gain in conjunction with the resistor 455 and capacitor 456 as well as stability in the output signal, the received voice signal 223.

The received voice signal 223 is coupled to one pole or terminal of the talk switch 214B. The talk switch 214B is normally closed so that IR voice signals are ordinarily converted into reproduced voice sounds by the speaker 208. An opposite pole of the talk switch 214B couples to an input of the operational amplifier 450 through the capacitor 462 with a resistor 463 coupled to ground 400. The operational amplifier 450 is an audio amplifier in one embodiment.

The sound effects signal 224 generated by the processor 220 couples to the other input of the operational amplifier 450 through a capacitor 465 and a resistor 466, with a resistor 467 coupled ground.

The processor 220 generates a hit signal 225 to turn on the hit lamp 217. The hit signal 225 is coupled to the base of a BJT 472 through a resistor 470. BJT 472 has an emitter coupled to ground and a collector coupled to the hit lamp 217. An opposite terminal of the hit lamp 217 couples to the positive power supply 401. The BJT 472 functions to drive and turn on the hit lamp 217 in response to the hit signal 225.

In other embodiments, the hit signal 225 maybe a parallel data signal over a bus which may be coupled to a more sophisticated display, such as a liquid crystal display to display data and other information regarding the laser tag game system.

The IR photodetector 404 receives an input IR beam to transduce it into an electrical signal. The IR photodetector 404 can be selectively powered on and off to receive an input IR beam. In particular, the IR photodetector 404 may be powered off in response to the shield switch 211 to avoid receiving a data tag or "hit" in a game of laser tag. Around the IR photodetector 404, an IR power signal 480 couples to the base of a BJT 482 through resistor 481. The emitter of the BJT 482 couples to the positive power supply node 401. A collector of the BJT 482 couples to a terminal of the infrared detector 404. An opposite terminal of the IR detector 404 couples to ground 400. The IR detector 404 generates a received data signal 229 on its output node. A resistor 484 for pull up is coupled between node 229 and the positive power supply node 401. The received data signal 229 is coupled into the processor 220 for processing in conjunction with the setting of the shield switch 211. The received data signal 229 may or may not drive the hit lamp 217 in response to a data tag.

As previously discussed, the toy laser tag gun may use one or more lenses. The one or more lenses may be used to collimate the light from a point source of the IR LED or focus collimated light from the focal plane into an IR photodiode or IR photodetector.

Figure 5A:
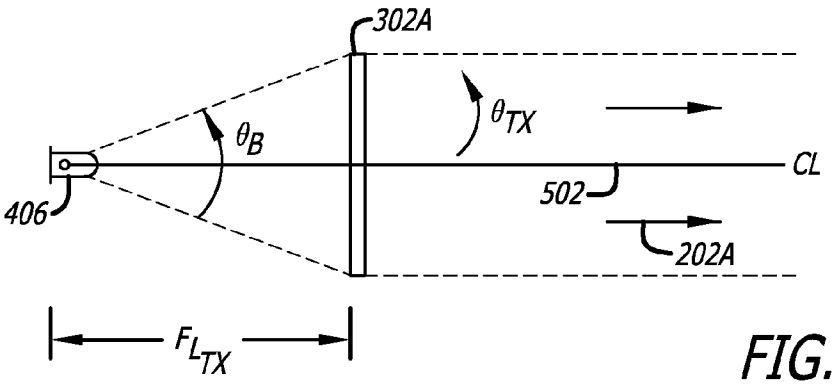
FIG. 5A is a cross-sectional view of a light ray diagram for an embodiment of the IR transmitter of the hand held electronic toy gun (i.e., toy laser tag gun).

Referring now to FIG. 5A, a light ray diagram for the IR LED 406 and the lens 302A is illustrated. The lens 302A in one embodiment is a fresnel lens. The center points of the optical axis of the IR LED 406 and the lens 302A are aligned along a center line 502. The IR LED 406 and the lens 302A are separated by a distance referred to as the focal length $Fl_{TX}$. The IR LED 406 radiates at a beam angle $\theta_B$. In one embodiment, the beam angle $\theta_B$ is twenty degrees for example. The lens 302A can collimate the light so that is spreads off of the center line 502 by a transmission angle $\theta_{TX}$. In one embodiment, the transmission angle $\theta_{TX}$ is one and one half degrees for example. In this manner the IR output light beam 202A can travel a long distance as a high intensity IR light beam.

Figure 5B:
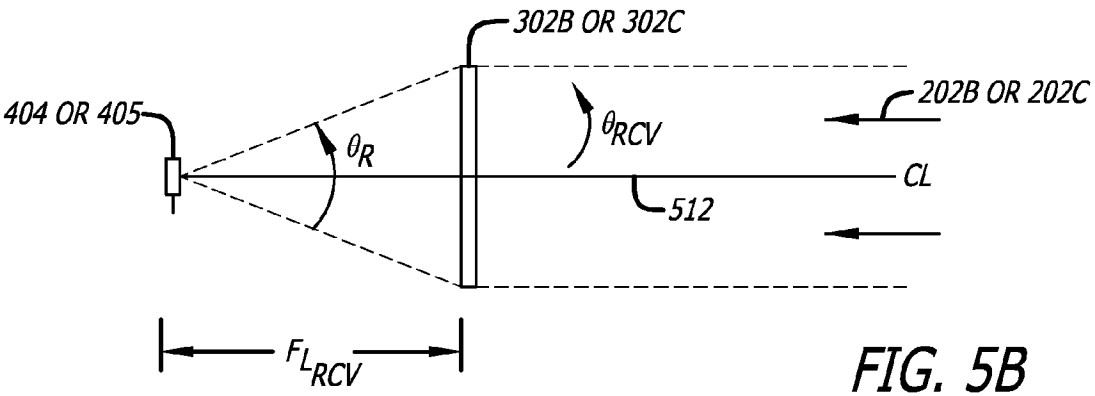
FIG. 5B is a cross-sectional view of a light ray diagram for an embodiment of the IR receiver of the hand held electronic toy gun (i.e., toy laser tag gun).

Referring now to FIG. 5B, a light ray diagram for the IR photodiode 405 or IR photodetector 404 and the lens 302B is illustrated. The light ray diagram for the lens 302C may be similar. The lens 302B in one embodiment is a fresnel lens. The lens 302C in one embodiment is a fresnel lens. The center points of the optical axis of the IR photo diode 405 and the lens 302B are aligned along a center line 512. The IR photodiode 405 and the lens 302B are separated by a distance referred to as the focal length $Fl_{RCV}$. Incoming IR light 202B or 202C in the focal plane along center line 512 and off of the center line by a reception angle $\theta_{RCV}$, is focused by the lens 302B down to a point of the reception area of the IR photodiode 405 or IR photodetector 404. In one embodiment, the reception angle $\theta_{RCV}$ is one and one half degrees. In one embodiment, the reception area of the IR photodiode 405 is seven square millimeters for example. The radiant sensitive area of the IR photodiode 405 is positioned at or near the focal point of lens 302B. In one embodiment for example, the focal length of lens 302B is 2.4 inches.

Typically, the IR LED 406 and the IR photodiode 404 are a matched pair as is the IR LED 406 and the IR photodiode 405. That is, the IR LED 406 and the IR photodiodes 404 and/or 405 may be constructed to transmit and receive IR radiation around the same center frequency or wavelength. For example, the IR LED 406 and the IR photodiode 405 have a center wavelength of 850 nanometers (nm) around which they can transmit and receive IR radiation. As another example, the IR LED 406 and the IR photodiode 405 have a center wavelength of 950 nanometers (nm) around which they can transmit and receive IR radiation. Other center wavelengths and frequencies may be used.

The toy laser tag gun 200 may be used for simplex or full duplex bi-directional communication with proper optical and/or electrical isolation to avoid signal feedback. Each of the IR communication channels 102A-102D may have the same center frequency or wavelength of IR radiation or they may have a different center frequency or wavelength of IR radiation. Using one IR communication channel, all the voice signals communicated in each direction are found on the same center wavelength or frequency. Because the IR radiation is light, there is little interference when signals cross over the IR communication channel between the toy laser tag guns 200. Alternatively, two IR communication channels may be provided, one for each direction of communication. In this case a different center frequency or wavelength is provided for the IR communication channel 102A from that of the IR communication channel 102B. The IR LED 406 and IR photodiodes 404/405 are matched across a pair of toy laser tag guns improving the quality of the IR communication between toy laser tag guns in the case of simplex or full duplex bi-directional communication.

Figure 5C:
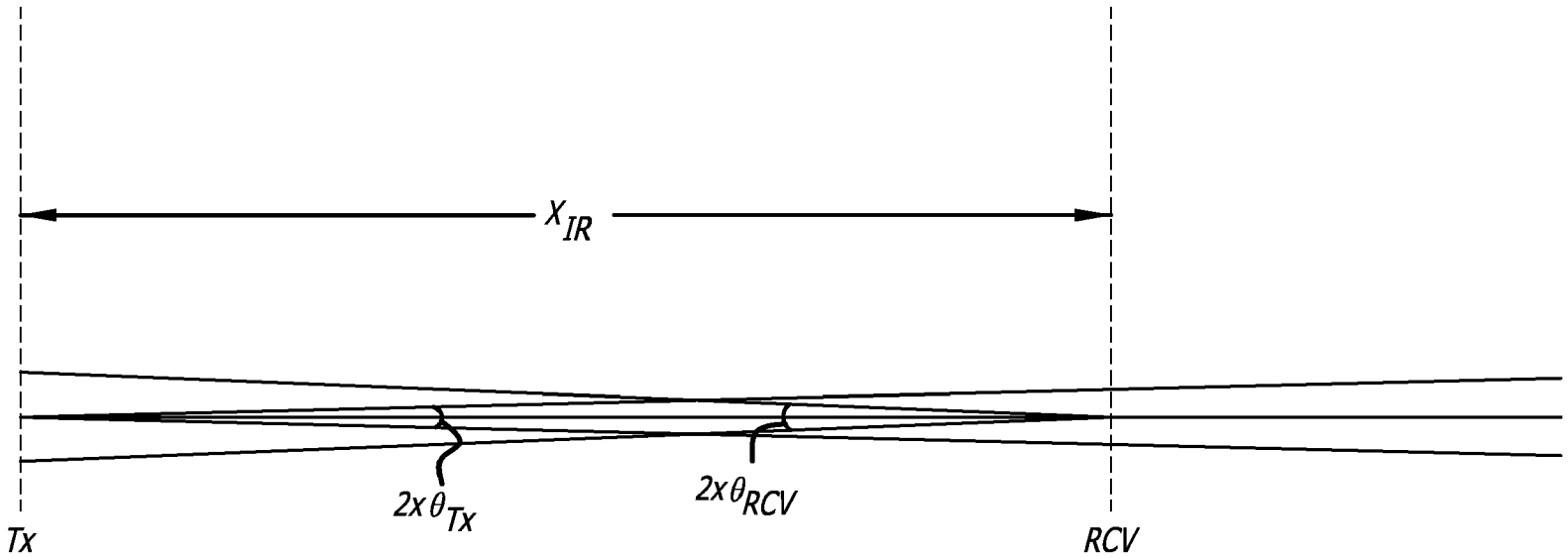
FIG. 5C is a cross-sectional view of overlapping light ray diagrams for an embodiment of the IR transmitter and the IR receiver between a pair of the hand held electronic toy guns (i.e., toy laser tag guns).

Referring now to FIG. 5C, a light ray diagram illustrates the functionality of one IR communication channel and the line of sight between two toy laser tag guns 200. FIG. 5C illustrates a single IR communication channel between a toy laser tag gun which is transmitting and another toy laser tag gun at an opposite end which is receiving. The toy laser tag guns are separated by a distance $X_{IR}$, referred to as an infrared communication distance.

At each end of the light ray diagram may be a lens of the toy laser tag gun. The lens in front of the IR receiver provides an angle of reception which is twice the angle of $\theta_{RCV}$ ($2\times\theta_{RCV}$). The lens in front of the IR transmitter on an opposite end of the communication channel provides an angle of transmission which is twice the angle of $\theta_{TX}$ ($2\times\theta_{TX}$). In one embodiment the angle of reception $2\times\theta_{RCV}$ is equal to the angle transmission $2\times\theta_{TX}$.

The distance $X_{IR}$ is more a function of the optical gain on the receiving side of the communication channel. The line of sight between the toy laser tag guns at each end of the communication channel is a function of the beam spread and the angle of acceptance. The beam spread is the amount the IR transmitted beam from one end of the IR communication channel is spread out to the angle of transmission $2\times\theta_{TX}$. In one embodiment $2\times\theta_{TX}$ is 3 degrees and the angle of reception or acceptance $2\times\theta_{RCV}$ is 5 degrees. Each of the lenses in front of the IR receiver and the IR transmitter can affect $\theta_{RCV}$ and $\theta_{TX}$ respectively.

In a preferred embodiment, a fresnel lens is used in front of the IR receiver to provide and improve optical gain on the receiving side of the IR communication channel. Using a fresnel lens in front of each of the IR transmitter and receiver has resulted in a range of $X_{IR}$ from approximately five feet to three thousand feet. In another embodiment, no lens is used in front of the IR photodiode 404 such that the range of distance of $X_{IR}$ is substantially reduced to approximately zero feet to fifty feet.

Because of the line-of-sight IR communication between the toy laser tag guns, its difficult for a third party to tap or eavesdrop on the communication between end users. Thus, the modulation or encoding scheme can be simple and not complex resulting in lower costs and still provide protected communication between end users.

Referring now to FIGS. 6A, 6B, 6C, and 6D exemplary waveforms illustrate how a voice signal representing audible sounds or voice sounds is detected by the microphone and directly modulated onto the IR transmitter at one end of the IR communication channel; and then detected at the infrared receiver and presented to the speaker at the other end of the IR communication channel.

Figures 6A, 6B, 6C, 6D:
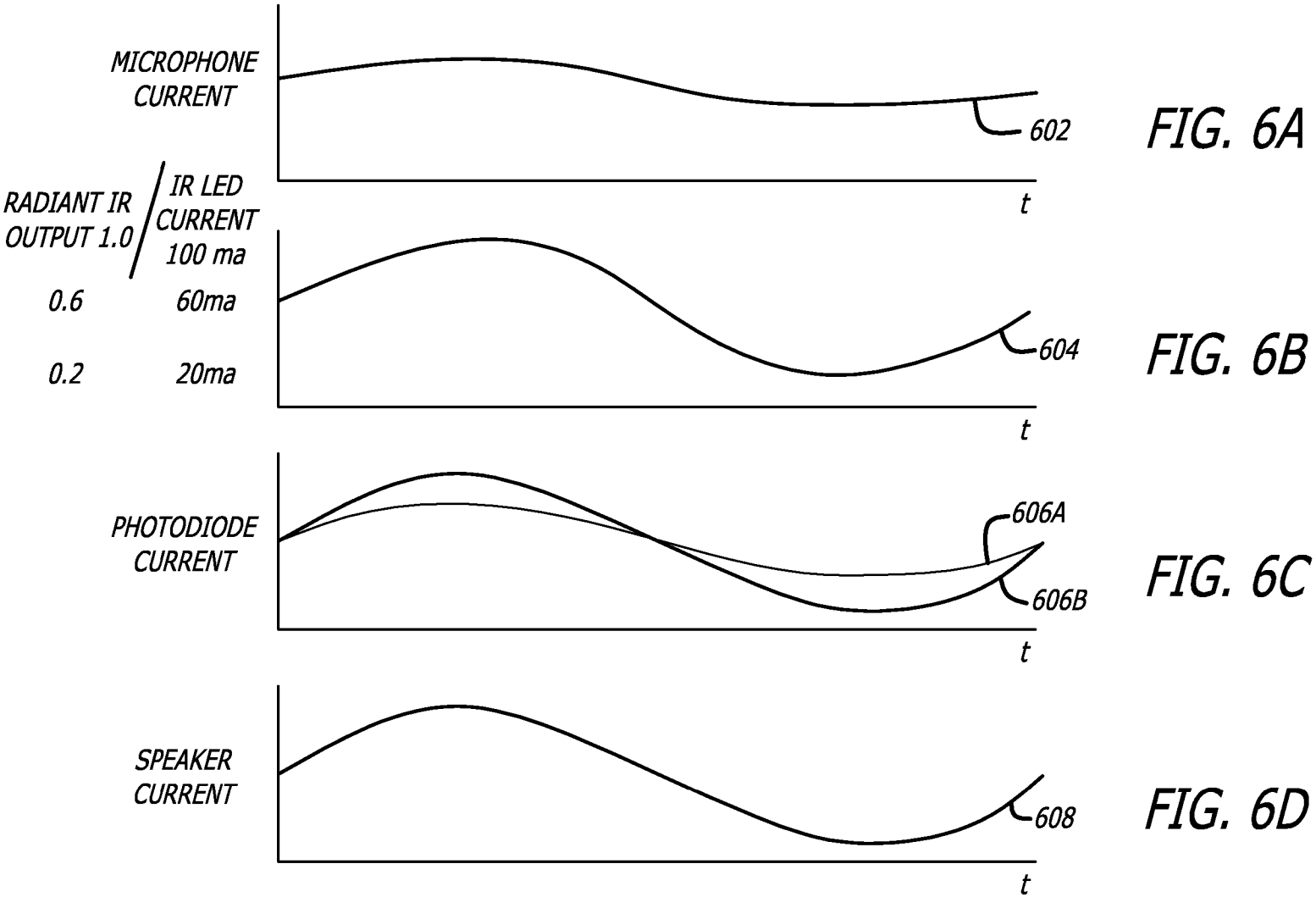
FIGS. 6A-6D are waveform diagrams illustrating direct modulation of IR voice signals used by the hand held electronic toy guns (i.e., toy laser tag guns) over IR communication channels.

In FIG. 6A, waveform 602 is illustrated. Waveform 602 represents a current waveform which is generated by the microphone receiving audible sounds or voice sounds and the amplifier 420 amplifying the voice signal of the microphone. The current waveform 602 is coupled through to the IR transmitter 206.

FIG. 6B illustrates a waveform 604 to indicate the current flowing through the infrared LED 406 and the resultant infrared LED output signal 202A. The relationship of the infrared LED current to infrared radiant output intensity is generally a linear function. Therefore, the infrared transmitter 206 generates infrared light at intensity levels that are directly responsive to the amplified microphone signal 602 of FIG. 6A.

FIG. 6C shows waveforms 606A and 606B to illustrate the current that may be generated by the photodiode of the IR receiver 204 of FIG. 2. Waveform 606A is illustrated as having a lower amplitude current signal than that of waveform 606B. A lower or higher amplitude of current signal is a direct result of the amount of infrared light incident on the photodiode 404 of the IR receiver 204. Waveforms 606A and 606B may also represent the transmitter and receiver being separated by different distances $X_{IR}$. For example, waveform 606A may indicate that the transmitter and receiver are separated by a first distance $X_{IR}$ of 2000 feet and waveform 606B may represent that the transmitter and receiver are separated by a second distance $X_{IR}$ of 500 feet. Alternatively, waveforms 606A and 606B may represent the transmitter and receiver being separated by an equal distance of 50 feet for example and the resultant difference in photodiode current between the waveforms is due to a change in optical gain characteristics through the use of different lenses or different focal lengths, etc. In this case the waveform 606A may illustrate an IR receiver 204 that does not have a focusing lens 302B in front of the IR photodiode 404 to achieve optical gain and waveform 606B may illustrate an IR receiver 204 that does have a focusing lens 302B in front of the IR photodiode 404 of the IR receiver 204.

FIG. 6D illustrates waveform 608 which is the audio current that is presented to the speaker. The current amplitude of the waveform 608 is amplified from that of the current amplitude of waveform 606A or 606B, illustrated in FIG. 6C, in order to properly drive the speaker 208. The frequency and amplitude of the waveform 608 is representative of the audible output generated by the speaker 208.

In this manner, the toy laser tag guns 200 at each end directly modulate an audible sound or voice in the audible frequency band between approximately 20 Hz to 20 kHz into an IR signal at the transmitting end for transmission over an IR communication channel and demodulate the received IR signal into an audible sound or audible voice sound between approximately 20 Hz to 20 kHz on the receiving end.

The disclosed embodiment does not employ a modulated center carrier frequency in order to achieve a lower cost. However, a center carrier frequency may be employed with the audible voice or sound modulated or mixed onto a center carrier frequency by using amplitude modulation (AM) or frequency modulation (FM) and then provided to the IR LED for transmission using an IR signal. Corresponding reception and demodulation or demixing on the receive end is used in order to obtain the baseband signal of the audible voice or sound. Details of this alternate embodiment of the infrared communication device would be understood by those ordinarily skilled in the art after reading through this disclosure.

The described toy laser tag gun including an IR receiver as a target facilitates a game of tag using infrared light communications between a plurality of players. Each player is equipped with the toy laser tag gun. The processor can generate sound effects similar to sounds of a gun in response to switches including the trigger switch. Additionally, the processor can generate light effects to simulate an aspect of a gun or indicate a hit or a kill. Additional input switches may be employed for additional sound and/or light generation and or facilitate communication between one or more players and the toy laser tag gun.

A exemplary laser tag game plan is as follows. Two (2) "hits" by an opposing player eliminates one "life." Each single hit lamp 217 represents two (2) lives. The first hit changes the hit lamp 217 to a solid ON. The second hit changes the hit lamp to flashing to indicate that the player has lost his life, for example. Additional hit lamps may be provided to increase the number of hits a player can take and lives a player may have. Once a player has been hit, e.g., twice, the unit may not function until the toy laser tag gun is turned off and then on again. If the player does not turn the toy laser tag gun off, it may beep periodically to remind the player to turn it off.

When the toy laser tag gun is powered on through the on/off switch 212, the processor may generate sound effects to indicate that the unit is powered up. To emit a single infrared (laser) strike, the trigger 216 is pressed or squeezed and released once activating the trigger switch 215 once. A rapid/continuous laser strike my be provided by the toy laser tag gun by pressing and holding the trigger 216 maintaining the trigger switch 215 in a closed position over a period of time. In the laser tag game, the rapid/continuous laser strike may be programmed so that it can only be used for a short period of time, such as five seconds at a time for example. After this period of time, the toy laser tag gun may only be able to emit a single strike for a period of time, such as ten seconds for example.

The laser tag game and the toy laser tag gun may provided several other features including a "shields" or "force field" feature and a "mega blast" or "super strike" feature. The shield switch 211 of the toy laser tag gun is used to implement the shields feature. The shields feature allows a player to effectively block a predetermined number of incoming hits or tags for a predetermined period of time, and send multiple signals or codes representing multiple signals. For example, three shields per game, each lasting three seconds, has been found to be satisfactory for the game play. Variations of these two parameters for the shields feature are within the scope of the invention.

The Mega Blast feature may allow a player to tag out an opposing player with one hit. In a preferred embodiment, the electronic game counts up to ten hits. With the Mega Blast feature, a toy laser tag gun may be able to deliver ten hits at once to tag a player out. In this case, the Mega Blast feature may be a single strike with the power of ten (10) regular strikes. To activate the Mega Blast feature a user presses or squeezes the trigger 212 and a special feature control button or switch, such as the shield switch, at the same time. In game play, the toy laser tag gun may have its processor programmed so that a player may only use the Mega Blast feature once during a game, for example, so that it is not overused during a game.

In each of these cases, the processor 220 may be programmed to accept certain input stimulus from a user via switches and to generate sounds, lights and display information regarding the game play. The game play can also be programmed into the processor 220 of each toy laser tag gun.

Additionally, the toy laser tag guns described herein provide audible voice communication between the players of the same team or across to players of an opposing team. The voice communication can be used to share status information with members of the same team such as how many lives are remaining by saying things like, "Joe, I only have one life left. You charge the enemy and I'll cover you." The voice communication provided by the laser tag gun can alternatively be used to intimidate or bluff an opposing player by saying things like, "I am gonna get you now!. Take that!"

While certain exemplary embodiments have been described and shown in the accompanying drawings, it is to be understood that such embodiments are merely illustrative of and not restrictive on the broad invention, and that this invention not be limited to the specific constructions and arrangements shown and described since various other modifications may occur to those ordinarily skilled in the art after reading the detailed description. Rather, the invention should be construed according to the claims that follow below.

What is claimed is:

1. A toy laser tag gun comprising:

a housing having a trigger switch to initiate tag signals;

a processor coupled to the trigger switch to process tag signals initiated by the trigger switch;

a first transmitter coupled to the processor, the first transmitter being an infrared transmitter to transmit tag signals;

a first receiver coupled to the processor, the first receiver being an infrared receiver to receive tag signals from another toy laser tag gun and couple the received tag signals to the processor;

a speaker coupled to the processor to transduce receive voice signals into audible voice sounds and to transduce receive tag signals into audible tag sounds;

a microphone to receive and transduce voice sounds into transmit voice signals;

a second transmitter to couple to the microphone, the second transmitter to immediately transmit, without recording, the transmit voice signals as the transmit voice signals are received from the microphone; and, a second receiver to couple to the speaker, the second receiver to receive transmit voice signals from another toy laser tag gun and to immediately couple, without recording, the transmit voice signals from another toy laser tag gun to the speaker as the transmit voice signals from another toy laser tag gun are received.

2. The toy laser tag gun of claim 1, wherein, the tag signal is a data signal.

3. The toy laser tag gun of claim 1, further comprising:

a talk switch coupled to the housing, the talk switch to couple the second transmitter to the microphone to enable transmission of the transmit voice signals and to disable the speaker and the transduction of receive voice signals into audible voice sounds.

4. The toy laser tag gun of claim 1, wherein, the second transmitter is a radio frequency transmitter and the second receiver is a radio frequency receiver.

5. The toy laser tag gun of claim 1, wherein, the second transmitter is an infrared transmitter and the second receiver is an infrared receiver.

6. A toy laser tag gun comprising:

a housing having a trigger switch, the trigger switch to initiate a tag signal;

a processor coupled to the trigger switch to process tag signals initiated by the trigger switch;

a microphone to receive and transduce voice sounds into voice signals;

a speaker to receive voice signals and transduce the voice signals into audible voice sounds;

an infrared transmitter coupled to the processor, the infrared transmitter to immediately transmit voice signals from the microphone and tag signals initiated by the trigger switch without recording; and, an infrared receiver coupled to the processor and the speaker, the infrared receiver to receive IR signals and provide tag signals to the processor and to receive voice signals immediately, without recording, to the speaker as IR signals are being received.

7. The toy laser tag gun of claim 6, wherein, the tag signal is a data signal.

8. The toy laser tag gun of claim 6, further comprising:

a talk switch coupled to the housing, the talk switch to enable transmission of the voice signals and disable the speaker.

9. A laser tag system comprising:

a first toy laser tag gun and a second toy laser tag gun for voice and data communication there-between, each of the toy laser tag guns including a trigger switch to initiate a tag signal;

a processor coupled to the trigger switch to process tag signals generated by the trigger switch;

a microphone to receive and transduce voice sounds into voice signals;

a speaker to receive voice signals and to immediately, without recording, transduce the voice signals into audible voice sounds;

an infrared transmitter coupled to the processor and the microphone, the infrared transmitter to directly transduce electrical signals into infrared signals of an infrared output light beam, the infrared transmitter to directly transmit, without recording, voice signals as received from the microphone and tag signals as initiated by the trigger switch; and, an infrared receiver coupled to the processor and the speaker, the infrared receiver to receive an infrared input light beam and transduce infrared signals therein into electrical signals, the infrared receiver to receive tag signals from another toy laser tag gun to couple to the processor and to receive voice signals to immediately couple to the speaker, without recording, as the signals are received, the processor also being coupled to the speaker to generate sound effects on receipt of tag signals.

10. The laser tag system of claim 9, wherein, the tag signal is a data signal.

11. The laser tag system of claim 9, wherein, each toy laser tag gun further includes a talk switch coupled to the microphone to enable transmission of the voice signals and disable the speaker.

12. A portable electronic tagging system comprising:

a toy laser tag gun for voice and data communication with another toy laser tag gun, the toy laser tag gun including a trigger switch to initiate a data signal;

a processor coupled to the trigger switch to process data signals;

an infrared receiver to transduce infrared signals of an infrared input light beam into electrical voice signals for reproduction;

an external speaker coupled to the infrared receiver, the external speaker to immediately transduce the electrical voice signals, without recording, for reproduction into audible voice sounds as the infrared signals are received;

a microphone to transduce audible voice sounds into electrical voice signals for transmission;

a talk switch coupled to the microphone, the talk switch to enable transduction of electrical voice signals for transmission into infrared signals of an infrared output light beam; and an infrared transmitter coupled to the talk switch and to the processor, the infrared transmitter to immediately transduce the electrical voice signals for transmission into the infrared signals of the infrared output light beam, without recording, as the electrical voice signals are received from the talk switch, and to transmit data signals from the processor.

13. The portable electronic tagging system of claim 12, wherein, the infrared receiver to further transduce the infrared signals of the infrared input light beam into data signals for processing by the processor.

14. The portable electronic tagging system of claim 12, wherein, the toy laser tag gun further includes an optical lens system for the infrared transmitter and the infrared receiver to increase the range of infrared communication with another toy laser tag gun.

15. The portable electronic tagging system of claim 14, wherein, the optical lens system is one or more fresnel lenses to focus infrared light into the infrared receiver and collimate infrared light out of the infrared transmitter.

16. The portable electronic tagging system of claim 12, wherein, the toy laser tag gun further includes a power supply, and an on/off switch coupled to the power supply, the one/off switch to switch power on and off to electrical components of the toy laser tag gun.

17. The portable electronic tagging system of claim 13, wherein, the toy laser tag gun further includes a hit lamp coupled to the processor, the hit lamp to indicate that a data signal was received.

18. The portable electronic tagging system of claim 17, wherein, the toy laser tag gun further includes a shield switch coupled to the processor, the shield switch to disable the reception of the data signal from another toy laser tag gun.

19. The portable electronic tagging system of claim 18, wherein, the external speaker is coupled to the infrared receiver through processor; and the toy laser tag gun further includes a volume switch coupled to the processor, the volume switch to control the amplitude of the audible sounds generated by the external speaker.

20. The portable electronic tagging system of claim 12, wherein, the infrared receiver of the toy laser tag gun is an external infrared receiver to be worn by a user and is electrically coupled to the toy laser tag gun.

21. The portable electronic tagging system of claim 20, wherein, the external speaker of the toy laser tag gun is configured to be worn by the user with the infrared receiver and is electrically coupled to the toy laser tag gun.

22. The portable electronic tagging system of claim 12, wherein, the toy laser tag gun further includes an external infrared receiver electrically connected to the processor to transduce infrared signals of another infrared input light beam into data signals.

23. A method comprising:

in a toy laser tag gun receiving a first infrared light beam;

transducing infrared voice signals of the first infrared light beam into electrical voice signals without recording the electrical voice signals;

coupling the electrical voice signals to a speaker as the first infrared light beam is received;

and, immediately transducing the electrical voice signals into audible voice sounds.

24. The method of claim 23, further comprising:

transducing infrared data signals of the first infrared light beam into electrical data signals;

and, processing the electrical data signals to control the operation of the toy laser tag gun.

25. A method comprising:

in a toy laser tag gun receiving a first infrared light beam;

transducing infrared voice signals of the first infrared light beam into electrical voice signals without recording the electrical voice signals;

coupling the electrical voice signals to a speaker as the first infrared light beam is being received;

immediately transducing the electrical voice signals into audible voice sounds;

receiving a second infrared light beam;

transducing infrared data signals of the second infrared light beam into electrical data signals;

and, processing the electrical data signals to control the operation of the toy laser tag gun.

26. The method of claim 25, further comprising:

in the toy laser tag gun transducing audible sounds into electrical sound signals;

and, transducing the electrical sound signals into infrared signals of a third infrared light beam.

27. The method of claim 26, further comprising:

in the toy laser tag gun transducing electrical data signals initiated by a trigger switch into infrared signals of a fourth infrared light beam.

28. The method of claim 23, further comprising:

in the toy laser tag gun transducing audible sounds into electrical sound signals;

and, transducing the electrical sound signals into infrared signals of a second infrared light beam.

29. The method of claim 28, further comprising:

in the toy laser tag gun transducing electrical data signals into infrared signals of the second infrared light beam.

30. A toy laser tag system comprising:

a target including a first processor to process data signals, a first infrared receiver to receive a first infrared input light beam and transduce infrared signals therein into electrical signals, the first infrared receiver to receive voice signals, a second infrared receiver coupled to the first processor, the second infrared receiver to receive a second infrared input light beam and transduce infrared signals therein into electrical signals, the second infrared receiver to receive data signals to couple to the first processor, and a first speaker to couple to the first processor and the first infrared receiver, the first speaker to transduce electrical signals into audible sounds, the first speaker to receive electrical sound effects signals from the first processor and receive the electrical voice signals from the first infrared receiver as the first infrared light beam is received; and a toy laser tag gun including a second processor to generate data signals and sound effects signals, a trigger switch coupled to the second processor to initiate data signals, a microphone to receive and transduce, without recording, voice sounds into voice signals, an infrared transmitter to couple to the second processor and the microphone, the infrared transmitter to transduce electrical signals into infrared signals of an infrared output light beam, the infrared transmitter to transmit the data signals and the voice signals, without recording, over the infrared output light beam as the voice sounds are received by the microphone, and a second speaker coupled to the second processor, the second speaker to transduce the sound effects signals into audible sound effects.

31. The toy laser tag system of claim 30, wherein, the data signal is a tag signal.

32. The toy laser tag system of claim 30, wherein, the toy laser tag gun further includes a talk switch coupled to the microphone, the talk switch to enable transduction of electrical voice signals for transmission into infrared signals of an infrared output light beam.

33. The toy laser tag system of claim 32, wherein, the talk switch further disables the second speaker and the transduction of electrical sound effects signals into audible sound effects.

34. The toy laser tag system of claim 30, wherein, the toy laser tag gun further includes a volume switch coupled to the second processor, the volume switch to adjust the amplitude of the sound effects signals and the resulting audible sound effects.

35. The toy laser tag system of claim 34, wherein, the toy laser tag gun further includes a first power supply, and a first on/off switch coupled between the first power supply and the second processor, the first on/off switch to turn on and off the toy laser tag gun.

36. The toy laser tag system of claim 35, wherein, the first power supply is a battery.

37. The toy laser tag system of claim 30, wherein, the target further includes a visual display coupled to the first processor, the visual display to display information regarding game play.

38. The toy laser tag system of claim 37, wherein, the visual display is a hit lamp.

39. The toy laser tag system of claim 30, wherein, the target further includes a volume switch coupled to the first processor, the volume switch to adjust the amplitude of the audible sound effects and voice generated by the first speaker.

40. The toy laser tag system of claim 30, wherein, the target further includes a shield switch coupled to the first processor, the shield switch to disable the recognition of reception of a data signal.

41. The toy laser tag system of claim 40, wherein, the data signal which the shield switch disables recognition is a tag signal.

42. The toy laser tag system of claim 40, wherein, the target further includes a second power supply, and a second on/off switch coupled between the second power supply and the first processor, the second on/off switch to turn on and off electrical devices in the target.

43. The toy laser tag system of claim 42, wherein, the second power supply is a battery.

44. The toy laser tag system of claim 30, wherein, the target further includes a bull's-eye coupled to a housing.

45. A toy laser tag system comprising:

a sound receiver including a first speaker to transduce electrical signals into audible voice sounds, and a first infrared receiver to receive voice signals over a first infrared input light beam, the first infrared receiver to transduce, without recording, infrared signals into electrical voice signals to couple to the speaker and the first speaker to transduce the electrical voice signals into audible voice sounds as the voice signals are received;

and a toy laser tag gun including a processor to generate tag signals and sound effects signals, a trigger switch coupled to the processor to initiate a tag signal, a microphone to receive and transduce voice sounds into voice signals, a first infrared transmitter to couple to the processor, the first infrared transmitter to transduce electrical signals into infrared signals of the infrared output light beam, the first infrared transmitter to transmit the tag signals and the voice signals over the infrared output light beam as the voice sounds are received by the microphone without recording the voice signals, a second infrared receiver coupled to the processor, the second infrared receiver to receive an infrared input light beam and transduce infrared signals therein into electrical signals, the second infrared receiver to receive tag signals from another toy laser tag gun to couple to the processor, and a second speaker coupled to the processor, the second speaker to transduce the sound effects signals into audible sound effects responsive to the tag signals.

46. The toy laser tag system of claim 45, wherein, the tag signal is responsive to the trigger switch.

47. The toy laser tag system of claim 45, wherein, the toy laser tag gun further includes a visual display coupled to the processor, the visual display to display information regarding game play.

48. The toy laser tag system of claim 47, wherein, the visual display is a hit lamp.

49. The toy laser tag system of claim 45, wherein, the toy laser tag gun further includes a shield switch coupled to the processor, the shield switch to disable the recognition of reception of a tag signal by the second infrared receiver.

50. The toy laser tag system of claim 45, wherein, the toy laser tag gun further includes a talk switch coupled to the microphone, the talk switch to enable transduction of electrical voice signals for transmission into infrared signals of an infrared output light beam by the first infrared transmitter.

51. The toy laser tag system of claim 50, wherein, the talk switch further disables the second speaker and the transduction of electrical sound effects signals into audible sound effects.

52. The toy laser tag system of claim 45, wherein, the toy laser tag gun further includes a volume switch coupled to the processor, the volume switch to adjust the amplitude of the electrical sound effects signals and the audible sound effects.

53. The toy laser tag system of claim 45, wherein, the toy laser tag gun further includes a first power supply, and a first on/off switch coupled between the first power supply and the second processor, the first on/off switch to turn on and off the toy laser tag gun.

54. The toy laser tag system of claim 53, wherein, the first power supply is a battery.

55. The toy laser tag system of claim 45, wherein, the sound receiver further includes an amplifier coupled between the first infrared receiver and the speaker to amplify the amplitude of electrical signals, and a volume switch coupled to the amplifier, the volume switch to adjust the amplitude of the electrical signals.

56. The toy laser tag system of claim 55, wherein, the sound receiver further includes a second power supply, and a second on/off switch coupled between the second power supply and the amplifier, the second on/off switch to turn on and off the sound receiver.

57. The toy laser tag system of claim 56, wherein, the second power supply is a battery.

58. A toy laser tag gun comprising:

a housing having a trigger switch, the trigger switch to initiate a tag signal;

a processor coupled to the trigger switch to process tag signals;

a microphone to receive and transduce voice sounds into transmit voice signals;

a speaker to transduce receive voice signals into audible voice sounds;

an infrared transmitter to selectively couple to the processor and the microphone, the infrared transmitter to selectively immediately transmit, without recording, the tag signal and the transmit voice signals as the voice sounds are received by the microphone;

a first infrared receiver coupled to the processor, the first infrared receiver to receive tag signals from another toy laser tag gun and couple the received tag signals to the processor; and, a second infrared receiver coupled to the speaker, the second infrared receiver to receive receive voice signals from another toy laser tag gun and to immediately couple the receive voice signals to the speaker as they are being received without recording.

59. The toy laser tag gun of claim 58, wherein, the tag signal is a data signal.

60. The toy laser tag gun of claim 58, further comprising:

a talk switch coupled to the housing, the talk switch to couple the infrared transmitter to the microphone to enable transmission of the transmit voice signals and to disable the speaker and the transduction of receive voice signals into audible voice sounds.

61. The toy laser tag gun of claim 58, further comprising:

a visual display coupled to the processor, the visual display to display information regarding game play.

62. The toy laser tag gun of claim 61, wherein, the visual display is a hit lamp.

63. The toy laser gun of claim 61, further comprising:

a shield switch coupled to the processor, the shield switch to disable recognition of a tag signal.

64. The toy laser tag gun of claim 58, further comprising:

a multiplexer having a first input coupled to the processor and a second input to couple to the microphone, the multiplexer further having an output coupled to the infrared transmitter, the multiplexer to selectively couple the processor to the infrared transmitter to transmit the tag signal and the microphone to the infrared transmitter to transmit the transmit voice signals.

65. The toy laser gun of claim 64, further comprising a talk switch coupled between the microphone and the multiplexer, the talk switch to couple the microphone to the second input of the multiplexer to enable transmission of the transmit voice signals.

66. The toy laser tag gun of claim 65, wherein, the talk switch to further disable the speaker and the transduction of receive voice signals into audible voice sounds.

67. The toy laser tag gun of claim 58, further comprising:

a volume switch coupled to the processor, the volume switch to adjust the amplitude of the audible voice sounds.

* * * * *